US005784041A

United States Patent [19]

Okada et al.

[11] Patent Number: 5,784,041

[45] Date of Patent: Jul. 21, 1998

[54] DRIVING CIRCUIT FOR DISPLAY DEVICE

[75] Inventors: Hisao Okada, Ikoma-gun; Sunao Eto, Tenri; Mikio Hashimoto, Nara, all of Japan

[73] Assignee: Sharp Kabushiki Kaisha, Osaka, Japan

[21] Appl. No.: 825,673

[22] Filed: Mar. 20, 1997

[30] Foreign Application Priority Data

Mar. 21, 1996 [JP] Japan ..... 8-065032

[51] Int. Cl.[6] ..... G09G 3/36

[52] U.S. Cl. ..... 345/89; 345/94

[58] Field of Search ..... 345/87, 89, 94, 345/95, 100, 208, 210, 211

[56] References Cited

U.S. PATENT DOCUMENTS 5,532,718 7/1996 Ishimaru ..... 345/89

FOREIGN PATENT DOCUMENTS 5-273520 10/1993 Japan .

OTHER PUBLICATIONS

Okada et al. "Development of a Low Votage Source Driver for Large TFT-LCD System for Computer Applications", IEEE, pp. 111-114, 1991.

*Primary Examiner*—Matthew Luu

*Attorney, Agent, or Firm*—Nixon & Vanderhye P.C.

[57] ABSTRACT

The driving circuit of this invention for a display device for displaying a plurality of gray levels in accordance with digital data including a first bit portion and a second bit portion includes: a first voltage dividing circuit for dividing a plurality of gray level voltages so as to generate a plurality of first interpolation voltages between the plurality of gray level voltages; a first selection circuit for selecting a first voltage and a second voltage different from the first voltage among the plurality of gray level voltages and the plurality of first interpolation voltages in accordance with the first bit portion of the digital data; a second voltage dividing circuit for dividing the first voltage and the second voltage so as to generate a plurality of second interpolation voltages between the first voltage and the second voltage; and a second selection circuit for selecting one voltage among at least one of the first voltage and the second voltage and the plurality of second interpolation voltages.

7 Claims, 23 Drawing Sheets

PRIOR ART

PRIOR ART

PRIOR ART

PRIOR ART

PRIOR ART

PRIOR ART

PRIOR ART

PRIOR ART

DRIVING CIRCUIT FOR DISPLAY DEVICE

BACKGROUND OF THE INVENTION

1. Field of the Invention

The present invention relates to a driving circuit for an active matrix type flat display device. More particularly, the present invention relates to a driving circuit for a liquid crystal display device which realizes gray-level display with 256 or more gray levels.

2. Description of the Related Art

FIG. 15 shows a configuration of a conventional driving circuit corresponding to one output of a 3-bit digital driver.

The driving circuit shown in FIG. 15 includes a sampling memory 131, a hold memory 132, and an output circuit 133. In response to a rising edge of a sampling pulse $T_{smp}$, 3-bit digital data $D_0$ to $D_2$ are stored in the sampling memory 131. The digital data stored in the sampling memory 131 are then transferred in response to a rising edge of an output pulse OP to the hold memory 132 to be held therein. The output circuit 133 outputs one of gray level voltages $V_0$ to $V_7$ supplied externally in accordance with the value of the digital data held in the hold memory 132 as an output voltage Out.

FIG. 16 shows a configuration of the output circuit 133 which includes a 3-to-8 decoder 141 and eight analog switches $ASW_0$ to $ASW_7$. The decoder 141 turns on one of the analog switches $ASW_0$ to $ASW_7$ in accordance with the value of the digital data. A gray level voltage supplied to the turned-on analog switch is output as the output voltage Out.

A digital driver having the configuration shown in FIGS. 15 and 16 has advantages of simple structure and small power consumption and thus has been widely used. Such a digital driver is described, for example, in H. Okada et al., "Development of a low voltage source driver for large TFT-LCD system for computer applications", 1991, International Display Research Conference, pp. 111–114.

The conventional digital driver with the above configuration requires the same number of gray level sources as that of gray levels to be displayed. This presents no problem for a 3-bit digital driver. However, a problem may occur when the digital driver is driven with more than 3 bits because the number of required gray level sources becomes too large. Especially, it is practically impossible to realize a 6 or more bit digital driver with the above configuration to provide a display with a large number of gray levels.

To overcome the above problem, there have been proposed various techniques for realizing a display with a large number of gray levels by generating interpolation voltages between gray level voltages supplied externally.

One example of such a technique is disclosed in Japanese Laid-Open Patent Publication No. 5-273520, which describes a circuit for generating interpolation voltages between adjacent gray level voltages by use of resistances generated in the circuit. One of the gray level voltages and the interpolation voltages is selected by a driving circuit and output to a data line of a display device via a buffer amplifier.

FIG. 17 shows a driving circuit 151 and a voltage dividing circuit 152 described in Japanese Laid-Open Patent Publication No. 5-273520 mentioned above. The driving circuit 151 corresponds to one output of a 4-bit digital driver.

The voltage dividing circuit 152 divides five external gray level voltages $V_0$, $V_4$, $V_8$, $V_{12}$, and $V_{15}$ by use of resistances to generate one or more interpolation voltages between respective adjacent gray level voltages. As a result, total 16 voltages $V_0$ to $V_{15}$ composed of the five gray level voltages and 11 interpolation voltages, for example, are supplied to the driving circuit 151.

The driving circuit 151 selects one of the 16 voltages $V_0$ to $V_{15}$ supplied from the voltage dividing circuit 152, and outputs the selected voltage via a buffer amplifier 157.

Referring to FIGS. 18A, 18B, 19, and 20, an application of the technique disclosed in Japanese Laid-Open Patent Publication No. 5-273520 mentioned above to a 6-bit digital driver will be described.

FIG. 18A shows a configuration of a voltage dividing circuit 162, which divides nine external gray level voltages $V_0$, $V_8$, $V_{16}$, $V_{24}$, $V_{32}$, $V_{40}$, $V_{48}$, $V_{56}$, and $V_{64}$ by use of resistances to generate seven interpolation voltages between respective adjacent gray level voltages. As a result, total 64 voltages $V_0$ to $V_{63}$ composed of eight gray level voltages and 56 interpolation voltages are supplied to a driving circuit 161.

FIG. 18B shows an array of eight resistances connected in series between the gray level voltages $V_0$ and $V_8$. Such an array of eight resistances is also provided between any of the other adjacent gray level voltages.

FIG. 19 shows a configuration of the driving circuit 161 which corresponds to one output of the 6-bit digital driver.

FIG. 20 shows a configuration of an output circuit 173 of the driving circuit 161 of FIG. 19, which includes a 6-to-64 decoder 181 and 64 analog switches $ASW_0$ to $ASW_{63}$. The 64 voltages $V_0$ to $V_{63}$ are supplied from the voltage dividing circuit 162 to the analog switches $ASW_0$ to $ASW_{63}$, respectively. The decoder 181 turns on one of the analog switches $ASW_0$ to $ASW_{63}$ in accordance with the value of digital data. A voltage supplied to the turned-on analog switch is output via a buffer amplifier 183 as an output voltage Out.

Referring to FIGS. 21A, 21B, 22, and 23, an application of the technique disclosed in Japanese Laid-Open Patent Publication No. 5-273520 mentioned above to an 8-bit digital driver will be described.

FIG. 21A shows a configuration of a voltage dividing circuit 192 which divides nine external gray level voltages $V_0$, $V_{32}$, $V_{64}$, $V_{96}$, $V_{128}$, $V_{160}$, $V_{192}$, $V_{224}$, and $V_{256}$ by use of resistances to generate 31 interpolation voltages between respective adjacent gray level voltages. As a result, a total of 256 voltages $V_0$ to $V_{255}$ composed of eight gray level voltages and 248 interpolation voltages are supplied to a driving circuit 191.

FIG. 21B shows an array of 32 resistances connected in series between the gray level voltages $V_0$ and $V_{32}$. Such an array of 32 resistances is also provided between any of the other adjacent gray level voltages.

FIG. 22 shows a configuration of the driving circuit 191 which corresponds to one output of the 8-bit digital driver.

FIG. 23 shows a configuration of an output circuit 203 of the driving circuit 191 of FIG. 22, which includes a 8-to-256 decoder 211 and 256 analog switches $ASW_0$ to $ASW_{255}$. The 256 voltages $V_0$ to $V_{255}$ are supplied from the voltage dividing circuit 192 to the analog switches $ASW_0$ to $ASW_{255}$, respectively. The decoder 211 turns on one of the analog switches $ASW_0$ to $ASW_{255}$ in accordance with the value of digital data. A voltage supplied to the turned-on analog switch is output via a buffer amplifier 213 as an output voltage Out.

According to the above conventional technique, the 6-bit digital driver requires total 64 resistances in the voltage dividing circuit 162 since eight resistances each are required between respective adjacent gray level voltages. On the other hand, the 8-bit digital driver requires total 256 resistances in the voltage dividing circuit 192 since 32 resistances each are required between respective adjacent gray level voltages. That is, the 8-bit digital driver requires four times as many resistances as the 6-bit digital driver does. This increases the area of the voltage dividing circuit of the 8-bit digital driver.

Moreover, in the 6-bit digital driver, 64 voltages $V_0$ to $V_{63}$ are supplied from the voltage dividing circuit 162 to the driving circuit 161. On the other hand, in the 8-bit digital driver, 256 voltages $V_0$ to $V_{255}$ are supplied from the voltage dividing circuit 192 to the driving circuit 191. These voltages output from the voltage dividing circuit are supplied to the driving circuit via voltage supply lines. That is, the 8-bit digital driver requires four times as many voltage supply lines as the 6-bit digital driver. This increases the area occupied by the voltage supply lines of the 8-bit digital driver by four times from that of the 6-bit digital driver, resulting in increasing the chip area.

The output circuit 203 of the 8-bit digital driver also becomes considerably larger than the output circuit 173 of the 6-bit digital driver for the following reasons. The 8-to-256 decoder 211 of the output circuit 203 of the 8-bit digital driver requires a considerably large number of logic gates compared with the 6-to-64 decoder 181 of the output circuit 173 of the 6-bit digital driver. Also, the output circuit 203 of the 8-bit digital driver requires four times as many analog switches as the output circuits 173 of the 6-bit digital driver.

The decoder is not necessarily composed of a combination of logic gates. For example, the decoder may also be composed of read-only memories (ROMs). Using ROMs, however, the 8-to-256 decoder 211 is still considerably larger than the 6-to-64 decoder 181.

One driver includes the same number of output circuits as that of drive terminals. As the size of the output circuit increases, therefore, the size of an LSI constituting the driver considerably increases.

For example, assume a digital driver having 240 drive terminals. When the size of one output circuit corresponds to 50 gates, the size of all output circuits in the driver corresponds to 12000 (=50×240) gates. When the size of one output circuit corresponds to 100 gates, the size of all output circuits in the digital driver corresponds to 24000 (=100×240) gates. Thus, though one driving circuit only has additional 50 gates, as many as 12000 gates are added in the entire digital driver.

Due to the above-described reasons, the 8-bit digital driver to be fabricated according to the conventional technique will become considerably large compared with the 6-bit digital driver. It is therefore practically impossible to realize an 8-bit digital driver by the conventional technique.

Therefore, there is a strong need in the art for a driving circuit which realizes a practical 8-bit digital driver without increase in the circuit size which overcomes the above-mentioned problems associated with prior art driving circuits.

SUMMARY OF THE INVENTION

The driving circuit of this invention for a display device for displaying a plurality of gray levels in accordance with digital data including a first bit portion and a second bit portion includes: a first voltage dividing circuit for dividing a plurality of gray level voltages so as to generate a plurality of first interpolation voltages between the plurality of gray level voltages; a first selection circuit for selecting a first voltage and a second voltage different from the first voltage among the plurality of gray level voltages and the plurality of first interpolation voltages in accordance with the first bit portion of the digital data; a second voltage dividing circuit for dividing the first voltage and the second voltage so as to generate a plurality of second interpolation voltages between the first voltage and the second voltage; and a second selection circuit for selecting one voltage among at least one of the first voltage and the second voltage and the plurality of second interpolation voltages.

In one embodiment of the invention, the driving circuit further includes an impedance converter connected to an output of the second selection circuit.

In another embodiment of the invention, the second voltage dividing circuit includes a plurality of resistances connected in series.

In still another embodiment of the invention, the second voltage dividing circuit includes a plurality of capacitances connected in series.

In still another embodiment of the invention, the first selection circuit determines whether or not a current loop from the first selection circuit through the second voltage dividing circuit back to the first selection circuit is shut off in accordance with the second bit portion of the digital data.

In still another embodiment of the invention, the driving circuit further includes: a first impedance converter for receiving the first voltage; and a second impedance converter for receiving the second voltage, wherein the second voltage dividing circuit divides an output of the first impedance converter and an output of the second impedance converter so as to generate the plurality of second interpolation voltages between the output of the first impedance converter and the output of the second impedance converter.

In still another embodiment of the invention, the driving circuit further includes a third impedance converter connected to the output of the second selection circuit.

Thus, according to the present invention, digital data including a first bit portion and a second bit portion is supplied to a driving circuit. A first voltage dividing circuit divides a plurality of gray level voltages supplied externally to generate a plurality of interpolation voltages between the plurality of gray level voltages. The plurality of gray level voltages supplied externally and the plurality of interpolation voltages generated by the first voltage dividing circuit are supplied to a first selection circuit. The first selection circuit selects a first voltage and a second voltage among the plurality of gray level voltages and the plurality of interpolation voltages. The first voltage and the second voltage which are different from each other are supplied to a second voltage dividing circuit. The second voltage dividing circuit divides the first voltage and the second voltage to generate a plurality of second interpolation voltages between the first and second voltages. The first voltage, the second voltage, and the plurality of second interpolation voltages generated by the second voltage dividing circuit are supplied to a second selection circuit. The second selection circuit selects one voltage among at least one of the first and second voltages and the plurality of second interpolation voltages. The voltage selected by the second selection circuit corresponds to one of a plurality of gray levels to be displayed on a display device and is output to a data line of the display device. The gray level corresponding to the value of the digital data is thus displayed on the display device.

In the case where the driving circuit further includes an impedance converter connected to an output of the second selection circuit, a current branching from the second voltage dividing circuit to the impedance converter is negligibly small compared with a current flowing through resistances in the second voltage dividing circuit. As a result, correct voltage division is realized by the second voltage dividing circuit.

Thus, the invention described herein makes possible the advantage of providing a driving circuit which realizes a practical 8-bit digital driver without increase in the circuit size.

These and other advantages of the present invention will become apparent to those skilled in the art upon reading and understanding the following detailed description with reference to the accompanying figures.

DESCRIPTION OF THE PREFERRED EMBODIMENTS

The present invention will be described by way of examples with reference to the accompanying drawings.

(EXAMPLE 1)

Figure 1:
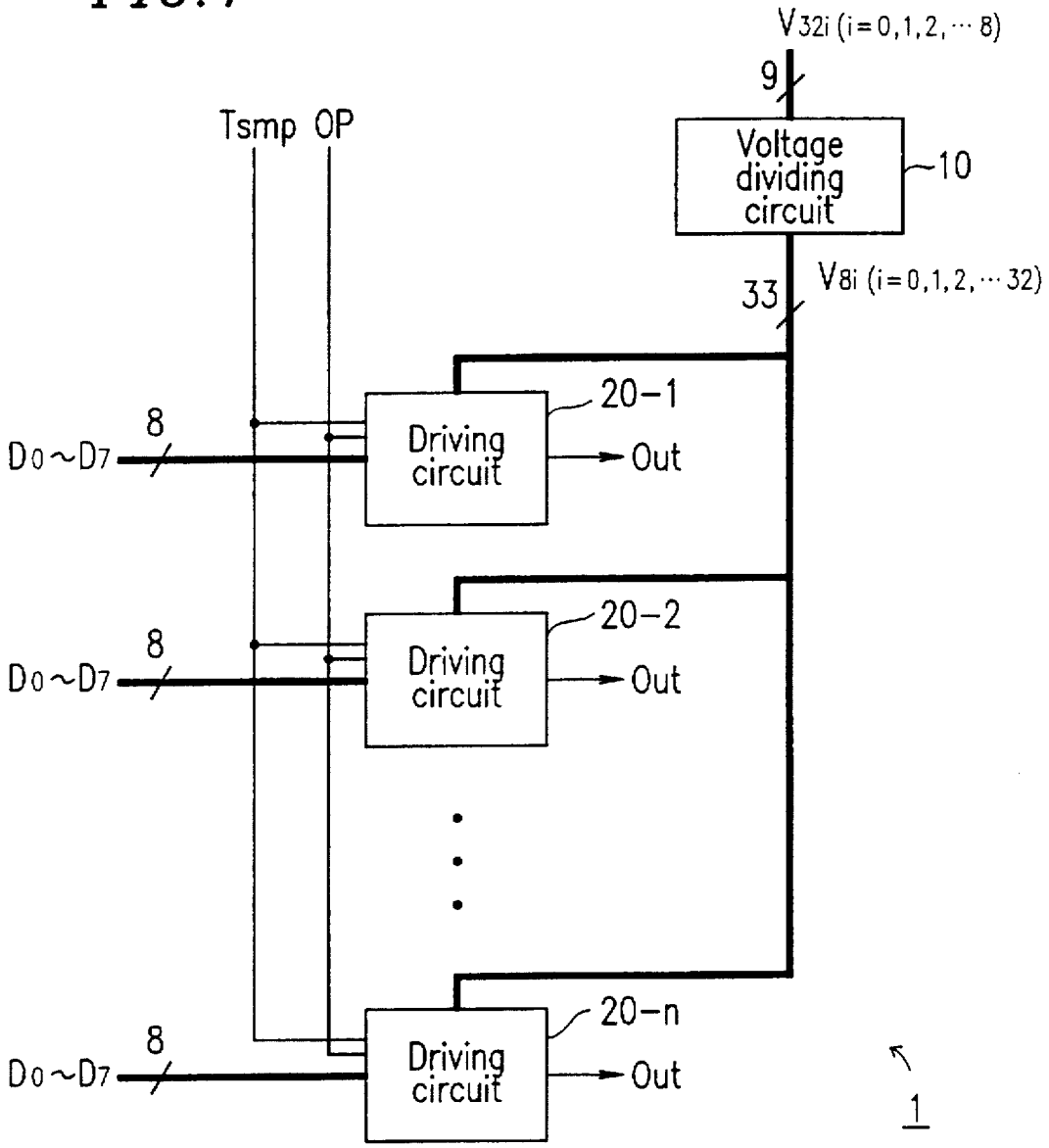
FIG. 1 is a block diagram of an 8-bit digital driver according to the present invention.

FIG. 1 shows a configuration of an 8-bit digital driver 1 according to the present invention. The driver 1 includes a voltage dividing circuit 10 and n driving circuits 20-1 to 20-n (n is a positive integer).

Figure 2A:
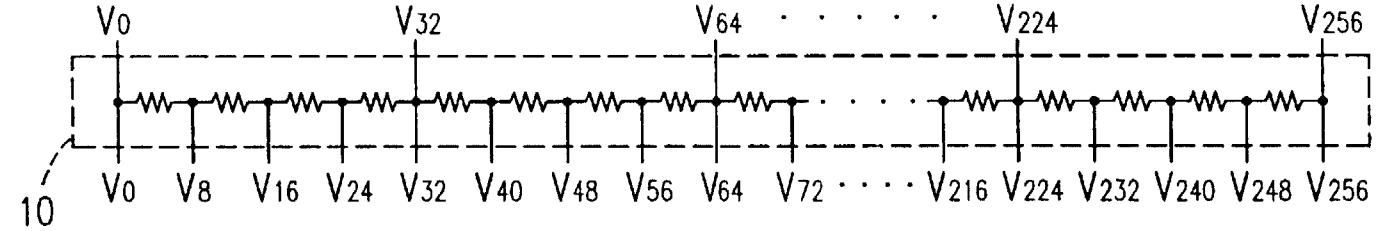
FIG. 2A shows a configuration of a voltage dividing circuit shown in FIG. 1.

As shown in FIG. 2A, the voltage dividing circuit 10 divides nine gray level voltages $V_0$, $V_{32}$, $V_{64}$, $V_{96}$, . . . , $V_{224}$, and $V_{256}$ supplied externally to generate total 24 interpolation voltages, and outputs a total of 33 voltages $V_0$, $V_8$, $V_{16}$, . . . , $V_{248}$, and $V_{256}$ including the gray level voltages and the interpolation voltages. Hereinbelow, the nine gray level voltages are denoted by $V_{32i}$ (i=0, 1, 2, . . . , 8), and the 33 voltages output from the voltage dividing circuit 10 are denoted by $V_{8i}$ (i=0, 1, 2, . . . , 32).

In the example shown in FIG. 1, the voltage dividing circuit 10 is shared by the n driving circuits 20-1 to 20-n. The size of the driver can be reduced by sharing the circuit as in this example. However, the present invention is not limited to this configuration, but a separate voltage dividing circuit may be provided for each of the n driving circuits 20-1 to 20-n.

Each of the driving circuits 20-1 to 20-n outputs an output voltage Out corresponding to input digital data to a data line (not shown) based on the voltages $V_{8i}$ (i=0, 1, 2, . . . , 32) supplied from the voltage dividing circuit 10. For example, when the digital data is composed of eight bits, $2^8$ (=256) output voltages Out are output. The data lines are put in connection with pixels (not shown) during one output period defined by an output pulse OP, allowing the pixels to be charged based on the respective output voltages Out. In this way, display with $2^8$ (=256) gray levels is realized.

FIG. 2A shows a configuration of the voltage dividing circuit 10 shown in FIG. 1. The nine gray level voltages $V_{32i}$ (i=0, 1, 2, . . . , 8) are input into the voltage dividing circuit 10. The voltage dividing circuit 10 has four resistances R between every two adjacent gray level voltages $V_{32i}$ (i=0, 1, 2, . . . , 8), and divides the gray level voltages $V_{32i}$ (i=0, 1, 2, . . . , 8) by use of the resistances R to generate total 24 interpolation voltages. Thus, a total of 33 voltages $V_{8i}$ (i=0, 1, 2, . . . , 32) including the gray level voltages and the interpolation voltages are output from the voltage dividing circuit 10. The total number of the gray level voltages and the interpolation voltages is designed to be smaller than a half of the number of output voltages determined by the number of bits of digital data operated by the driver.

Figure 2B:
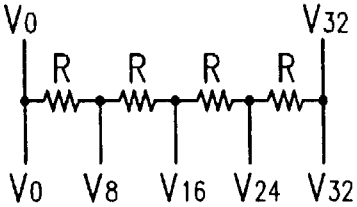
FIG. 2B is a partial view of the voltage dividing circuit of FIG. 2A.

FIG. 2B shows an array of the resistances R connected in series between the gray level voltages $V_0$ and $V_{32}$ shown in FIG. 2A. Such an array of four resistances R is also provided between any of the other gray level voltages.

Figure 3A:
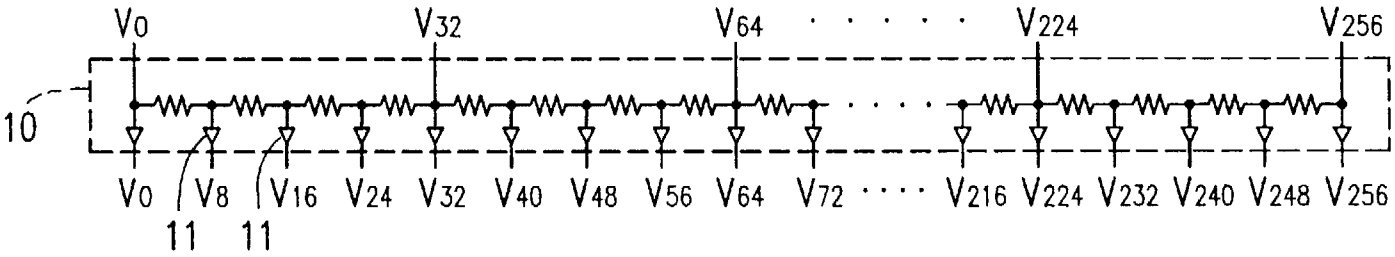
FIG. 3A shows another configuration of the voltage dividing circuit shown in FIG. 1.

FIG. 3A shows another configuration of the voltage dividing circuit 10, where an impedance converter 11 is provided for each output of the voltage dividing circuit 10. The impedance converter 11 converts a high input impedance into a low output impedance. According to the impedance converter 11, an input voltage is output In without any change, and a large current can be obtained from the output side while a current hardly flows to the input side. A voltage follower, for example, is used as the impedance converter 11.

The voltage dividing circuit 10 with the impedance converters 11 can operate a large load. Therefore, the voltage dividing circuit 10 is preferably provided with the impedance converter 11 for each output when it is connected with the plurality of driving circuits 20-1 to 20-n as in the illustrated example.

Figure 3B:
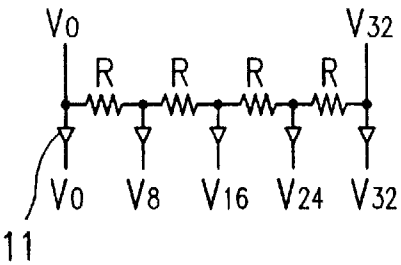
FIG. 3B is a partial view of the voltage dividing circuit of FIG. 3A.

FIG. 3B shows an array of the resistances R connected in series between the gray level voltages $V_0$ and $V_{32}$ shown in FIG. 3A. Such an array of 4 resistances R is also provided between any of the other gray level voltages.

Figure 4:
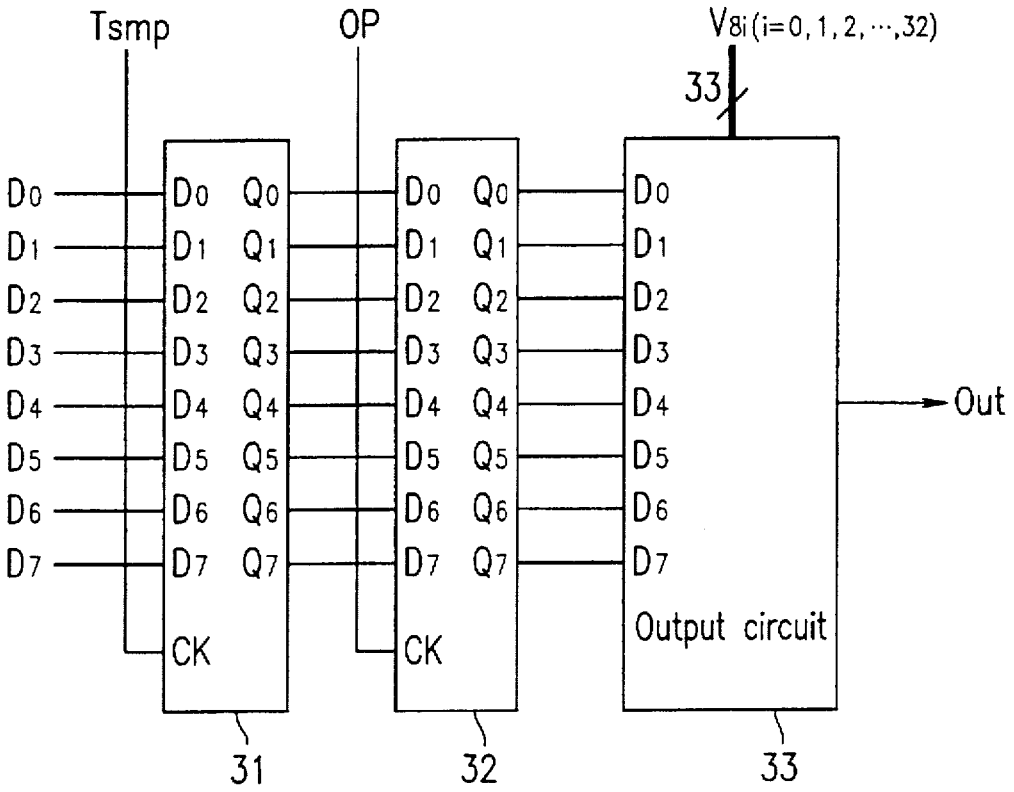
FIG. 4 is a block diagram of a driving circuit shown in FIG. 1.

FIG. 4 shows a configuration of the driving circuit 20-1 shown in FIG. 1, which corresponds to one output of the 8-bit digital driver 1.

The driving circuit 20-1 includes a sampling memory 31, a hold memory 32, and an output circuit 33. In response to a rising edge of a sampling pulse $T_{smp}$, 8-bit digital data $D_0$ to $D_7$ are stored in the sampling memory 31. The stored data are then transferred in response to a rising edge of an output pulse OP to the hold memory 32 to be held therein. The output circuit 33 outputs an output voltage Out corresponding to the value of the digital data held in the hold memory 32 based on the voltages $V_{8i}$ (i=0, 1, 2, . . . , 32) supplied from the voltage dividing circuit 10.

The other driving circuits 20-2 to 20-n have the same configuration as the driving circuit 20-1 described above.

Figure 5:
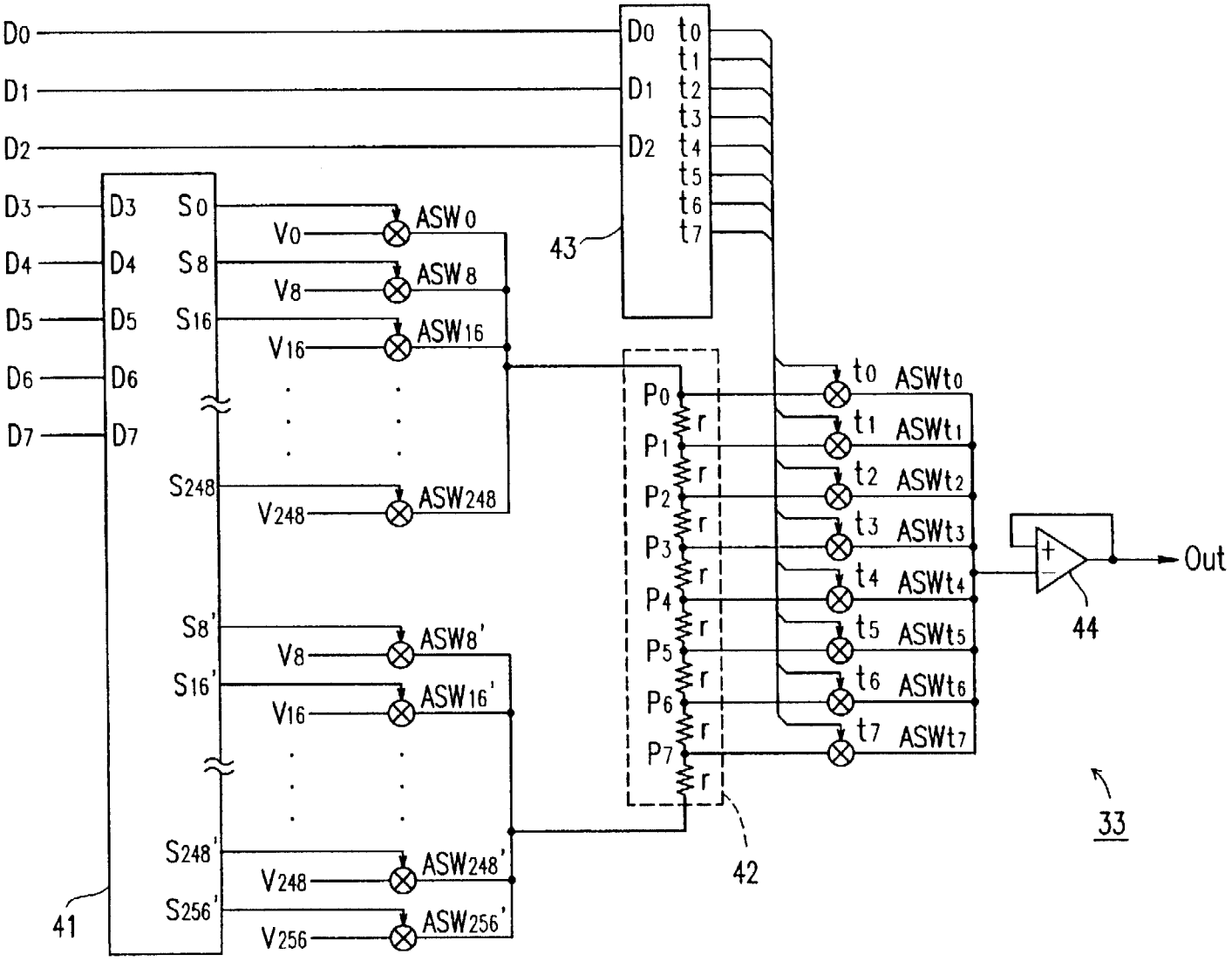
FIG. 5 is a block diagram of an output circuit of the driving circuit of FIG. 4.

FIG. 5 shows a configuration of the output circuit 33 shown in FIG. 4. The output circuit 33 includes a logic circuit 41, a voltage dividing circuit 42, a logic circuit 43, and an impedance converter 44.

The logic circuit 41 receives five most significant bits of the 8-bit digital data, and activates one of 32 control signals $S_0$, $S_8$, $S_{16}$, . . . , $S_{248}$ and one of 32 control signals $S_{8'}$, $S_{16'}$, $S_{24'}$, . . . , $S_{256'}$ based on the value of the five most significant bits.

The control signals $S_0$, $S_8$, $S_{16}$, . . . , $S_{248}$ are supplied to analog switches (analog gates) $ASW_0$, $ASW_8$, $ASW_{16}$, . . . , $ASW_{248}$, while the control signals $S_{8'}$, $S_{16'}$, $S_{24'}$, . . . , $S_{256'}$ are supplied to analog switches (analog gates) $ASW_{8'}$, $ASW_{16'}$, $ASW_{24'}$, . . . , $ASW_{256'}$. Each of these analog switches is configured to be turned on when the input control signal is active.

The analog switches (analog gates) $ASW_0$, $ASW_8$, $ASW_{16}$, . . . , $ASW_{248}$ receive the voltages $V_0$, $V_8$, $V_{16}$, . . . , $V_{248}$, respectively. The analog switches (analog gates) $ASW_{8'}$, $ASW_{16'}$, $ASW_{24'}$, . . . , $ASW_{256'}$ receive the voltages $V_8$, $V_{16}$, $V_{24}$, . . . , $V_{256}$, respectively. Each of these analog switches is configured to output the input voltage without any change when it is turned on.

The voltage dividing circuit 42 has eight resistances r connected in series. The eight resistances r have an equivalent resistance value. An output from the analog switches $ASW_0$, $ASW_8$, $ASW_{16}$, . . . , $ASW_{248}$ is applied to one end of the series of the eight resistances r, while an output from the analog switches $ASW_{8'}$, $ASW_{16'}$, $ASW_{24'}$, . . . , $ASW_{256'}$ is applied to the other end thereof. The voltage dividing circuit 42 divides the voltages applied to both ends of the series of the eight resistances r to generate eight different voltages at connecting points $P_0$, $P_1$, $P_2$, . . . , $P_7$. The voltage at the connecting point $P_0$ is equal to the voltage output from the analog switches $ASW_0$, $ASW_8$, $ASW_{16}$, . . . , $ASW_{248}$, while the voltages at the connecting points $P_1$, $P_2$, . . . , $P_7$ are equal to voltages obtained by dividing the voltage between the both ends in accordance with the number of the resistances r.

The logic circuit 43 receives the remaining three least significant bits of the 8-bit digital data, and activates one of eight control signals $t_0$ to $t_7$ based on the value of the three least significant bits.

The control signals $t_0$ to $t_7$ are supplied to analog switches (analog gates) $ASW_{t0}$ to $ASW_{t7}$, respectively. Each of these analog switches is configured to be turned on when the input control signal is active.

The analog switches (analog gates) $ASW_{t0}$ to $ASW_{t7}$ also receive the eight voltages obtained by the voltage dividing circuit 42. Each of these analog switches is configured to output the input voltage without any change when it is turned on.

Thus, one of the eight voltages obtained by the voltage dividing circuit 42 is selected by the logic circuit 43 in accordance with the three least significant bits of the digital data, and the selected voltage is output to the impedance converter 44. The function and operation of the impedance converter 44 is the same as those of the impedance converter 11 described above. The description thereof is therefore omitted here.

One of the voltages at the connecting points $P_0$, $P_1$, . . . , $P_7$ is input into the impedance converter 44 having a very large input impedance via the corresponding one of the analog switches $ASW_{t0}$ to $ASW_{t7}$. As a result, a current branching from any of the connecting points $P_0$, $p_1$, . . . , $P_7$ to the impedance converter 44 is negligibly small compared with a current flowing through the resistances r in the voltage dividing circuit 42. Thus, correct voltage division is realized.

The impedance converter 44 may be omitted when the load to be operated by the driver is small.

Table 1 below is a logic table defining the relationships between the values of the five most significant bits $D_7$ to $D_3$ of the digital data input into the logic circuit 41 and the values of the control signals $S_0$, $S_8$, $S_{16}$, . . . $S_{248}$ output from the logic circuit 41. Table 2 below is a logic table defining the relationships between the values of the five most significant bits $D_7$ to $D_3$ of the digital data input into the logic circuit 41 and the values of the control signals $S_{8'}$, $S_{16'}$, $S_{24'}$, . . . , $S_{256'}$ output from the logic circuit 41.

TABLE 1

| $D_7$ | $D_6$ | $D_5$ | $D_4$ | $D_3$ | $S_0$ | $S_8$ | $S_{16}$ | $S_{24}$ | $S_{32}$ | $S_{40}$ | $S_{48}$ | $S_{56}$ | $S_{64}$ | $S_{72}$ | $S_{80}$ | $S_{88}$ | $S_{96}$ | $S_{104}$ | $S_{112}$ | $S_{120}$ | $S_{128}$ |
|---|---|---|---|---|---|---|---|---|---|---|---|---|---|---|---|---|---|---|---|---|---|
| 0 | 0 | 0 | 0 | 0 | 1 | | | | | | | | | | | | | | | | |
| 0 | 0 | 0 | 0 | 1 | | 1 | | | | | | | | | | | | | | | |
| 0 | 0 | 0 | 1 | 0 | | | 1 | | | | | | | | | | | | | | |
| 0 | 0 | 0 | 1 | 1 | | | | 1 | | | | | | | | | | | | | |
| 0 | 0 | 1 | 0 | 0 | | | | | 1 | | | | | | | | | | | | |
| 0 | 0 | 1 | 0 | 1 | | | | | | 1 | | | | | | | | | | | |
| 0 | 0 | 1 | 1 | 0 | | | | | | | 1 | | | | | | | | | | |
| 0 | 0 | 1 | 1 | 1 | | | | | | | | 1 | | | | | | | | | |
| 0 | 1 | 0 | 0 | 0 | | | | | | | | | 1 | | | | | | | | |
| 0 | 1 | 0 | 0 | 1 | | | | | | | | | | 1 | | | | | | | |
| 0 | 1 | 0 | 1 | 0 | | | | | | | | | | | 1 | | | | | | |
| 0 | 1 | 0 | 1 | 1 | | | | | | | | | | | | 1 | | | | | |
| 0 | 1 | 1 | 0 | 0 | | | | | | | | | | | | | 1 | | | | |

TABLE 1-continued

| | | | | | | | | | | | | | | | | | | | | |
|---|---|---|---|---|---|---|---|---|---|---|---|---|---|---|---|---|---|---|---|---|
| 0 | 1 | 1 | 0 | 1 | | | | | | | | | | | | 1 | | | | |
| 0 | 1 | 1 | 1 | 0 | | | | | | | | | | | | | 1 | | | |
| 0 | 1 | 1 | 1 | 1 | | | | | | | | | | | | | | 1 | | |
| 1 | 0 | 0 | 0 | 0 | | | | | | | | | | | | | | | | 1 |
| 1 | 0 | 0 | 0 | 1 | | | | | | | | | | | | | | | | |
| 1 | 0 | 0 | 1 | 0 | | | | | | | | | | | | | | | | |
| 1 | 0 | 0 | 1 | 1 | | | | | | | | | | | | | | | | |
| 1 | 0 | 1 | 0 | 0 | | | | | | | | | | | | | | | | |
| 1 | 0 | 1 | 0 | 1 | | | | | | | | | | | | | | | | |
| 1 | 0 | 1 | 1 | 0 | | | | | | | | | | | | | | | | |
| 1 | 0 | 1 | 1 | 1 | | | | | | | | | | | | | | | | |
| 1 | 1 | 0 | 0 | 0 | | | | | | | | | | | | | | | | |
| 1 | 1 | 0 | 0 | 1 | | | | | | | | | | | | | | | | |
| 1 | 1 | 0 | 1 | 0 | | | | | | | | | | | | | | | | |
| 1 | 1 | 0 | 1 | 1 | | | | | | | | | | | | | | | | |
| 1 | 1 | 1 | 0 | 0 | | | | | | | | | | | | | | | | |
| 1 | 1 | 1 | 0 | 1 | | | | | | | | | | | | | | | | |
| 1 | 1 | 1 | 1 | 0 | | | | | | | | | | | | | | | | |
| 1 | 1 | 1 | 1 | 1 | | | | | | | | | | | | | | | | |

| $D_7$ | $D_6$ | $D_5$ | $D_4$ | $D_3$ | $S_{136}$ | $S_{144}$ | $S_{152}$ | $S_{160}$ | $S_{168}$ | $S_{176}$ | $S_{184}$ | $S_{192}$ | $S_{200}$ | $S_{208}$ | $S_{216}$ | $S_{224}$ | $S_{232}$ | $S_{240}$ | $S_{248}$ |
|---|---|---|---|---|---|---|---|---|---|---|---|---|---|---|---|---|---|---|---|
| 0 | 0 | 0 | 0 | 0 | | | | | | | | | | | | | | | |
| 0 | 0 | 0 | 0 | 1 | | | | | | | | | | | | | | | |
| 0 | 0 | 0 | 1 | 0 | | | | | | | | | | | | | | | |
| 0 | 0 | 0 | 1 | 1 | | | | | | | | | | | | | | | |
| 0 | 0 | 1 | 0 | 0 | | | | | | | | | | | | | | | |
| 0 | 0 | 1 | 0 | 1 | | | | | | | | | | | | | | | |
| 0 | 0 | 1 | 1 | 0 | | | | | | | | | | | | | | | |
| 0 | 0 | 1 | 1 | 1 | | | | | | | | | | | | | | | |
| 0 | 1 | 0 | 0 | 0 | | | | | | | | | | | | | | | |
| 0 | 1 | 0 | 0 | 1 | | | | | | | | | | | | | | | |
| 0 | 1 | 0 | 1 | 0 | | | | | | | | | | | | | | | |
| 0 | 1 | 0 | 1 | 1 | | | | | | | | | | | | | | | |
| 0 | 1 | 1 | 0 | 0 | | | | | | | | | | | | | | | |
| 0 | 1 | 1 | 0 | 1 | | | | | | | | | | | | | | | |
| 0 | 1 | 1 | 1 | 0 | | | | | | | | | | | | | | | |
| 0 | 1 | 1 | 1 | 1 | | | | | | | | | | | | | | | |
| 1 | 0 | 0 | 0 | 0 | | | | | | | | | | | | | | | |
| 1 | 0 | 0 | 0 | 1 | 1 | | | | | | | | | | | | | | |
| 1 | 0 | 0 | 1 | 0 | | 1 | | | | | | | | | | | | | |
| 1 | 0 | 0 | 1 | 1 | | | 1 | | | | | | | | | | | | |
| 1 | 0 | 1 | 0 | 0 | | | | 1 | | | | | | | | | | | |
| 1 | 0 | 1 | 0 | 1 | | | | | 1 | | | | | | | | | | |
| 1 | 0 | 1 | 1 | 0 | | | | | | 1 | | | | | | | | | |
| 1 | 0 | 1 | 1 | 1 | | | | | | | 1 | | | | | | | | |
| 1 | 1 | 0 | 0 | 0 | | | | | | | | 1 | | | | | | | |
| 1 | 1 | 0 | 0 | 1 | | | | | | | | | 1 | | | | | | |
| 1 | 1 | 0 | 1 | 0 | | | | | | | | | | 1 | | | | | |
| 1 | 1 | 0 | 1 | 1 | | | | | | | | | | | 1 | | | | |
| 1 | 1 | 1 | 0 | 0 | | | | | | | | | | | | 1 | | | |
| 1 | 1 | 1 | 0 | 1 | | | | | | | | | | | | | 1 | | |
| 1 | 1 | 1 | 1 | 0 | | | | | | | | | | | | | | 1 | |
| 1 | 1 | 1 | 1 | 1 | | | | | | | | | | | | | | | 1 |

TABLE 2

| $D_7$ | $D_6$ | $D_5$ | $D_4$ | $D_3$ | $S_8'$ | $S_{16}'$ | $S_{24}'$ | $S_{32}'$ | $S_{40}'$ | $S_{48}'$ | $S_{56}'$ | $S_{64}'$ | $S_{72}'$ | $S_{80}'$ | $S_{88}'$ | $S_{96}'$ | $S_{104}'$ | $S_{112}'$ | $S_{120}'$ | $S_{128}'$ | $S_{136}'$ |
|---|---|---|---|---|---|---|---|---|---|---|---|---|---|---|---|---|---|---|---|---|---|
| 0 | 0 | 0 | 0 | 0 | 1 | | | | | | | | | | | | | | | | |
| 0 | 0 | 0 | 0 | 1 | | 1 | | | | | | | | | | | | | | | |
| 0 | 0 | 0 | 1 | 0 | | | 1 | | | | | | | | | | | | | | |
| 0 | 0 | 0 | 1 | 1 | | | | 1 | | | | | | | | | | | | | |
| 0 | 0 | 1 | 0 | 0 | | | | | 1 | | | | | | | | | | | | |
| 0 | 0 | 1 | 0 | 1 | | | | | | 1 | | | | | | | | | | | |
| 0 | 0 | 1 | 1 | 0 | | | | | | | 1 | | | | | | | | | | |
| 0 | 0 | 1 | 1 | 1 | | | | | | | | 1 | | | | | | | | | |
| 0 | 1 | 0 | 0 | 0 | | | | | | | | | 1 | | | | | | | | |
| 0 | 1 | 0 | 0 | 1 | | | | | | | | | | 1 | | | | | | | |
| 0 | 1 | 0 | 1 | 0 | | | | | | | | | | | 1 | | | | | | |
| 0 | 1 | 0 | 1 | 1 | | | | | | | | | | | | 1 | | | | | |
| 0 | 1 | 1 | 0 | 0 | | | | | | | | | | | | | 1 | | | | |
| 0 | 1 | 1 | 0 | 1 | | | | | | | | | | | | | | 1 | | | |
| 0 | 1 | 1 | 1 | 0 | | | | | | | | | | | | | | | 1 | | |
| 0 | 1 | 1 | 1 | 1 | | | | | | | | | | | | | | | | 1 | |
| 1 | 0 | 0 | 0 | 0 | | | | | | | | | | | | | | | | | 1 |

TABLE 2-continued

| | | | | | | | | | | | | | | | | | | | | | |
|---|---|---|---|---|---|---|---|---|---|---|---|---|---|---|---|---|---|---|---|---|---|
| 1 | 0 | 0 | 0 | 1 | | | | | | | | | | | | | | | | | |
| 1 | 0 | 0 | 1 | 0 | | | | | | | | | | | | | | | | | |
| 1 | 0 | 0 | 1 | 1 | | | | | | | | | | | | | | | | | |
| 1 | 0 | 1 | 0 | 0 | | | | | | | | | | | | | | | | | |
| 1 | 0 | 1 | 0 | 1 | | | | | | | | | | | | | | | | | |
| 1 | 0 | 1 | 1 | 0 | | | | | | | | | | | | | | | | | |
| 1 | 0 | 1 | 1 | 1 | | | | | | | | | | | | | | | | | |
| 1 | 1 | 0 | 0 | 0 | | | | | | | | | | | | | | | | | |
| 1 | 1 | 0 | 0 | 1 | | | | | | | | | | | | | | | | | |
| 1 | 1 | 0 | 1 | 0 | | | | | | | | | | | | | | | | | |
| 1 | 1 | 0 | 1 | 1 | | | | | | | | | | | | | | | | | |
| 1 | 1 | 1 | 0 | 0 | | | | | | | | | | | | | | | | | |
| 1 | 1 | 1 | 0 | 1 | | | | | | | | | | | | | | | | | |
| 1 | 1 | 1 | 1 | 0 | | | | | | | | | | | | | | | | | |
| 1 | 1 | 1 | 1 | 1 | | | | | | | | | | | | | | | | | |
| | | $D_7$ | $D_6$ | $D_5$ | $D_4$ | $D_3$ | $S_{144}'$ | $S_{152}'$ | $S_{160}'$ | $S_{168}'$ | $S_{176}'$ | $S_{184}'$ | $S_{192}'$ | $S_{200}'$ | $S_{208}'$ | $S_{216}'$ | $S_{224}'$ | $S_{232}'$ | $S_{240}'$ | $S_{248}'$ | $S_{256}'$ |
| | | 0 | 0 | 0 | 0 | 0 | | | | | | | | | | | | | | | |
| | | 0 | 0 | 0 | 0 | 1 | | | | | | | | | | | | | | | |
| | | 0 | 0 | 0 | 1 | 0 | | | | | | | | | | | | | | | |
| | | 0 | 0 | 0 | 1 | 1 | | | | | | | | | | | | | | | |
| | | 0 | 0 | 1 | 0 | 0 | | | | | | | | | | | | | | | |
| | | 0 | 0 | 1 | 0 | 1 | | | | | | | | | | | | | | | |
| | | 0 | 0 | 1 | 1 | 0 | | | | | | | | | | | | | | | |
| | | 0 | 0 | 1 | 1 | 1 | | | | | | | | | | | | | | | |
| | | 0 | 1 | 0 | 0 | 0 | | | | | | | | | | | | | | | |
| | | 0 | 1 | 0 | 0 | 1 | | | | | | | | | | | | | | | |
| | | 0 | 1 | 0 | 1 | 0 | | | | | | | | | | | | | | | |
| | | 0 | 1 | 0 | 1 | 1 | | | | | | | | | | | | | | | |
| | | 0 | 1 | 1 | 0 | 0 | | | | | | | | | | | | | | | |
| | | 0 | 1 | 1 | 0 | 1 | | | | | | | | | | | | | | | |
| | | 0 | 1 | 1 | 1 | 0 | | | | | | | | | | | | | | | |
| | | 0 | 1 | 1 | 1 | 1 | | | | | | | | | | | | | | | |
| | | 1 | 0 | 0 | 0 | 0 | | | | | | | | | | | | | | | |
| | | 1 | 0 | 0 | 0 | 1 | 1 | | | | | | | | | | | | | | |
| | | 1 | 0 | 0 | 1 | 0 | | 1 | | | | | | | | | | | | | |
| | | 1 | 0 | 0 | 1 | 1 | | | 1 | | | | | | | | | | | | |
| | | 1 | 0 | 1 | 0 | 0 | | | | 1 | | | | | | | | | | | |
| | | 1 | 0 | 1 | 0 | 1 | | | | | 1 | | | | | | | | | | |
| | | 1 | 0 | 1 | 1 | 0 | | | | | | 1 | | | | | | | | | |
| | | 1 | 0 | 1 | 1 | 1 | | | | | | | 1 | | | | | | | | |
| | | 1 | 1 | 0 | 0 | 0 | | | | | | | | 1 | | | | | | | |
| | | 1 | 1 | 0 | 0 | 1 | | | | | | | | | 1 | | | | | | |
| | | 1 | 1 | 0 | 1 | 0 | | | | | | | | | | 1 | | | | | |
| | | 1 | 1 | 0 | 1 | 1 | | | | | | | | | | | 1 | | | | |
| | | 1 | 1 | 1 | 0 | 0 | | | | | | | | | | | | 1 | | | |
| | | 1 | 1 | 1 | 0 | 1 | | | | | | | | | | | | | 1 | | |
| | | 1 | 1 | 1 | 1 | 0 | | | | | | | | | | | | | | 1 | |
| | | 1 | 1 | 1 | 1 | 1 | | | | | | | | | | | | | | | 1 |

The logic circuit 41 operates in accordance with the logic defined in Tables 1 and 2 above. In Tables 1 and 2, each blank indicates that the value of the control signal is "0". When the value of the control signal is "0" (inactive), the corresponding analog switch is turned off. When the value of the control signal is "1" (active), the corresponding analog switch is turned on.

Table 3 below is a logic table defining the relationships between the values of the three least significant bits $D_2$ to $D_0$ of the digital data input into the logic circuit 43 and the values of the control signals $t_0$ to $t_7$ output from the logic circuit 43.

TABLE 3

| $D_2$ | $D_1$ | $D_0$ | $t_0$ | $t_1$ | $t_2$ | $t_3$ | $t_4$ | $t_5$ | $t_6$ | $t_7$ |
|---|---|---|---|---|---|---|---|---|---|---|
| 0 | 0 | 0 | 1 | | | | | | | |
| 0 | 0 | 1 | | 1 | | | | | | |
| 0 | 1 | 0 | | | 1 | | | | | |
| 0 | 1 | 1 | | | | 1 | | | | |
| 1 | 0 | 0 | | | | | 1 | | | |
| 1 | 0 | 1 | | | | | | 1 | | |
| 1 | 1 | 0 | | | | | | | 1 | |
| 1 | 1 | 1 | | | | | | | | 1 |

TABLE 3-continued

The logic circuit 43 operates in accordance with the logic defined in Table 3 above. In Table 3, each blank indicates that the value of the control signal is "0". When the value of the control signal is "0" (inactive), the corresponding analog switch is turned off. When the value of the control signal is "1" (active), the corresponding analog switch is turned on.

Hereinbelow, an exemplified operation of the output circuit 33 will be described. Assume that digital data $D_7$ to $D_0$ which corresponds to 4 in decimal notation, i.e., ($D_7$, $D_6$, $D_5$, $D_4$, $D_3$, $D_2$, $D_1$, $D_0$)=(0, 0, 0, 0, 0, 1, 0, 0) is input into the output circuit 33.

Since all of the five most significant bits $D_7$ to $D_3$ are "0", the logic circuit 41 activates the control signal $S_0$ in accordance with Table 1. As a result, the voltage $V_0$ is applied to one end of the voltage dividing circuit 42 via the analog switch $ASW_0$.

Since all of the five most significant bits $D_7$ to $D_3$ are "0", the logic circuit 41 activates the control signal $S_8$, in accordance with Table 2. As a result, the voltage $V_8$ is applied to the other end of the voltage dividing circuit 42 via the analog switch $ASW_8$.

Since the three least significant bits $D_2$ to $D_0$ are "1", "0", and "0", respectively, the logic circuit 43 activates the control signal $t_4$ in accordance with Table 3. As a result, the voltage at the connecting point $P_4$ of the voltage dividing circuit 42 is output to the impedance converter 44 via the analog switch $ASW_{t4}$.

The voltage at the connecting point $P_4$ of the voltage dividing circuit 42 is equal to $(4V_0+4V_8)/8$ $(=(V_0+V_8)/2)$. This is because four resistances r connected in series intervene between the one end of the voltage dividing circuit 42 to which the voltage $V_0$ is applied and the connecting point $P_4$, while four resistances r connected in series intervene between the other end of the voltage dividing circuit 42 to which the voltage $V_8$ is applied and the connecting point $P_4$.

Thus, the output circuit 33 outputs a voltage $(4V_0+4V_8)/8$ $(=(V_0+V_8)/2)$ for the digital data corresponding to 4 in decimal notation.

The logic circuit 41 may have any configuration as long as it operates as defined in Tables 1 and 2 above. For example, the logic circuit 41 may be realized by a combination of logical devices such as AND and OR or by ROMs. This also applies to the logic circuit 43.

When the present invention is applied to an actual driver, the following points should be considered.

The first point is the relationship between the value of an ON resistance $r_{ON}$ of each analog switch and the value of the resistance r in the voltage dividing circuit 42 of the output circuit 33.

Figure 6:
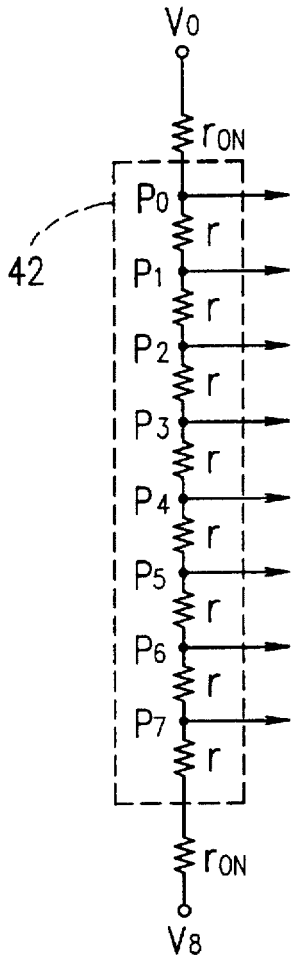
FIG. 6 is an equivalent circuit of a voltage dividing circuit of the output circuit of FIG. 5.

FIG. 6 is an equivalent circuit of the voltage dividing circuit 42 obtained when the analog switches $ASW_0$ and $ASW_8$, are turned on. That is, the voltage $V_0$ is applied to one end of the voltage dividing circuit 42, while the voltage $V_8$, is applied to the other end thereof.

Under the above state, the ON resistances $r_{NO}$ of the analog switches are added to both ends of the series of the eight resistances r in the voltage dividing circuit 42. As a result, each of the voltages at the connecting points $P_0$ to $P_7$ of the voltage dividing circuit 42 is no more equal to the voltage obtained by dividing the voltage applied between both ends of the voltage dividing circuit 42 by eight.

In order to minimize this deviation, the ON resistance $r_{ON}$ is preferably as small as possible compared with the resistance r. However, an extreme reduction of the ON resistance $r_{ON}$ with respect to the resistance r (e.g., a reduction by 1/10 or more) presents a problem of increasing the chip size.

Figure 7:
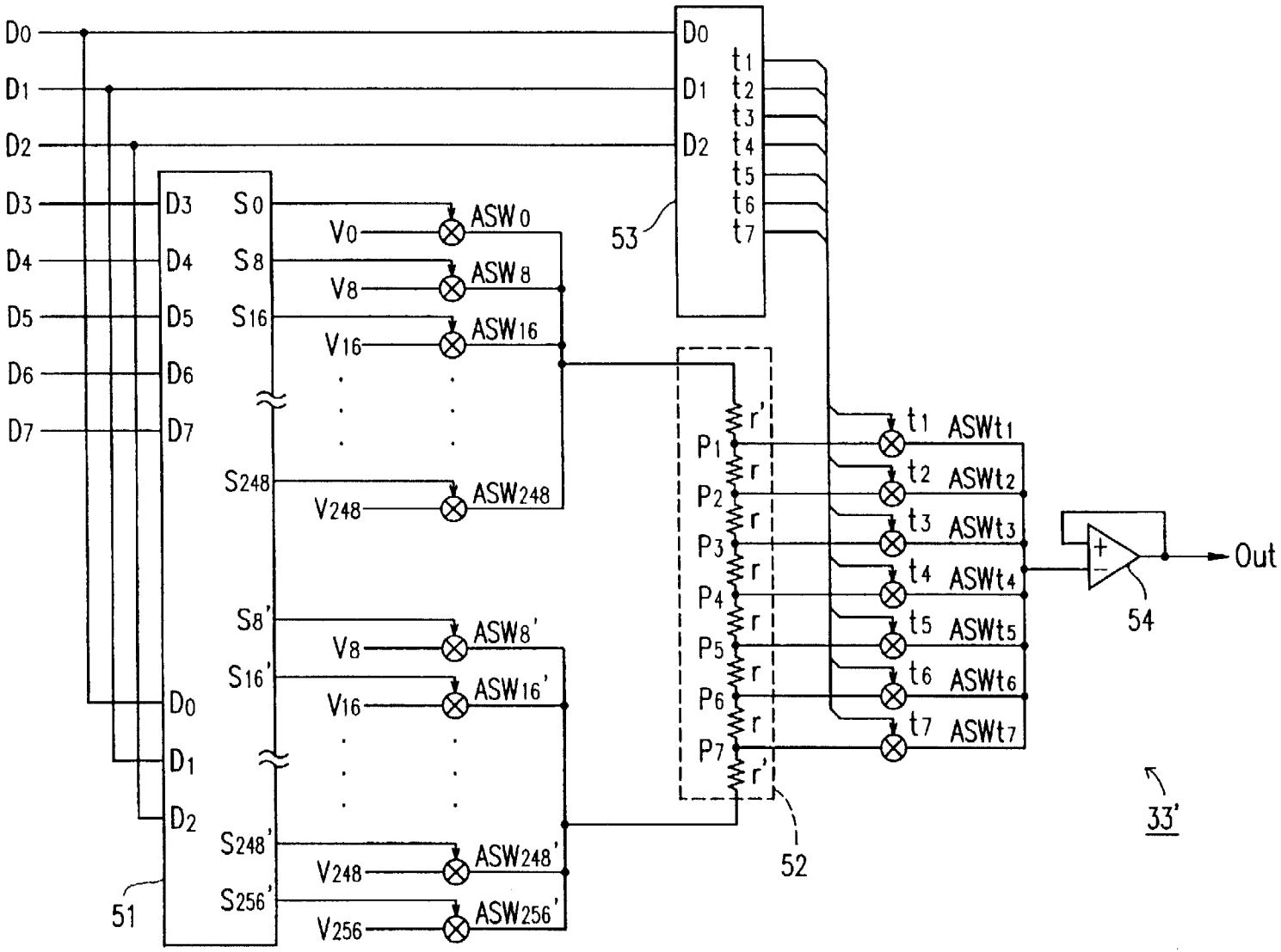
FIG. 7 is a block diagram of a modified output circuit including an improved voltage dividing circuit according to the present invention.

FIG. 7 shows an output circuit 33' including a voltage dividing circuit 52 improved to overcome the above problem.

The voltage dividing circuit 52 includes eight resistances connected in series. Two resistances r' at both ends among the eight resistances are designed to be different from other resistances r and satisfy $r_{ON}+r'=r$.

Figure 8:
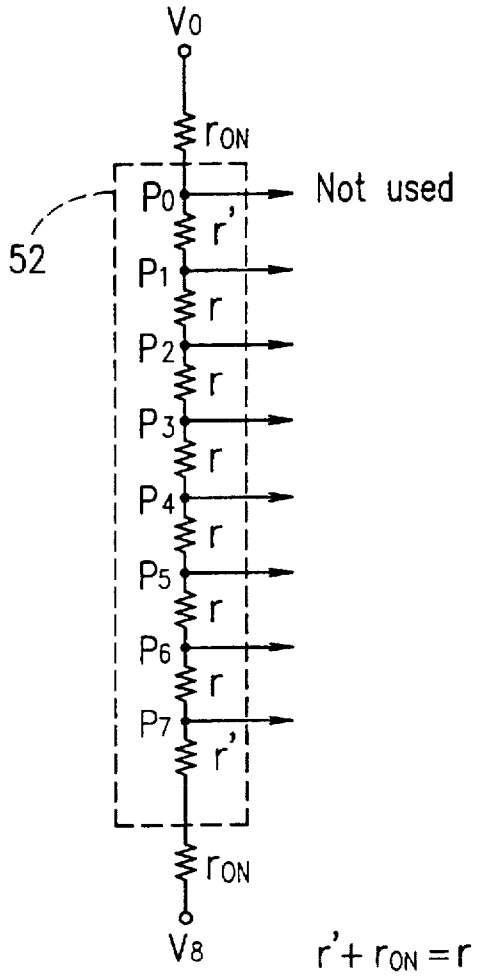
FIG. 8 is an equivalent circuit of the voltage dividing circuit shown in FIG. 7.

FIG. 8 is an equivalent circuit of the voltage dividing circuit 52 obtained when the analog switches $ASW_0$ and $ASW_8$, are turned on. Since $r_{ON}+r'=r$, the voltages at the connecting points $P_0$ to $P_7$ of the voltage dividing circuit 52 are equal to the voltages obtained by dividing the voltage applied between both ends of the voltage dividing circuit 52 by eight.

In this case, the voltage at the connecting point $P_0$ of the voltage dividing circuit 52 is not used because the voltage $V_0$ applied to one end of the voltage dividing circuit 52 and the voltage at the connecting point $P_0$ are not equal to each other due to voltage fall (or voltage rise) caused by the ON resistance $r_{ON}$. For example, when $r_{ON}=r'$, the voltage at the connecting point $P_0$ is $(15V_0+V_8)/16$.

A logic circuit 51 inactivates all the control signals $S_8$, $S_{16}$, $S_{24}$, . . . , $S_{256}$, when all the three least significant bits of the digital data are "0", regardless of the values of the five most significant bits. As a result, all of the analog switches $ASW_8$, $ASW_{16}$, $ASW_{24}$, . . . , $ASW_{256}$, are turned off, shutting off a current loop from the logic circuit 51 through the analog switch $ASW_{8l}$, the voltage dividing circuit 52, and the analog switch $ASW_{8l}$, back to the logic circuit 51 (or a reverse current loop).

The values of the control signals $S_8$, $S_{16}$, $S_{24}$, . . . , $S_{256}$, are as shown in Table 2 in the cases other than the case where all three least significant bits of the digital data are "0".

The values of the control signals $S_0$, $S_8$, $S_{16}$, . . . , $S_{248}$ are always as shown in Table 1 regardless of the values of the three least significant bits of the digital data.

The control of the logic circuit 51 as described above can be realized by adding logic to be followed when all the three least significant bits of the digital data are "0".

A logic circuit 53 activates one of the control signals $t_1$ to $t_7$ when all the three least significant bits of the digital data are "0". The control signal to be activated when all the three least significant bits of the digital data are "0" may be any of the control signals $t_1$ to $t_7$. This is because under this state the voltages at the connecting points $P_1$ to $P_7$ of the voltage dividing circuit 52 are equal to the voltage applied to the one end of the voltage dividing circuit 52.

More specifically, the current loop from the logic circuit 51 through the voltage dividing circuit 52 back to the logic circuit 51 is shut off as described above when all the three least significant bits of the digital data are "0". Under this state, no current flows through the ON resistances $r_{ON}$, the resistances r', and the resistances r, permitting no voltage fall (or voltage rise) to be caused by these resistances. Therefore, the voltages at the connecting points $P_1$ to $P_7$ of the voltage dividing circuit 52 are equal to the voltage applied to the one end of the voltage dividing circuit 52.

Table 4 below is a logic table defining the relationship between the values of the three least significant bits of the digital data input into the logic circuit 53 and values of the control signals $t_1$ to $t_7$ output from the logic circuit 53.

TABLE 4

| $D_2$ | $D_1$ | $D_0$ | $t_1$ | $t_2$ | $t_3$ | $t_4$ | $t_5$ | $t_6$ | $t_7$ |
|---|---|---|---|---|---|---|---|---|---|
| 0 | 0 | 0 | 1 | | | | | | |
| 0 | 0 | 1 | 1 | | | | | | |
| 0 | 1 | 0 | | 1 | | | | | |
| 0 | 1 | 1 | | | 1 | | | | |
| 1 | 0 | 0 | | | | 1 | | | |
| 1 | 0 | 1 | | | | | 1 | | |
| 1 | 1 | 0 | | | | | | 1 | |
| 1 | 1 | 1 | | | | | | | 1 |

The logic circuit 53 operates in accordance with the logic defined in Table 4 above. In Table 4, each blank indicates that the value of the control signal is "0". When the value of the control signal is "0" (inactive), the corresponding analog switch is turned off. When the value of the control signal is "1" (active), the corresponding analog switch is turned on. In this example shown in Table 4, when all the three least significant bits are "0", the control signal $t_1$ is activated.

As described above, the analog switch $ASW_{r0}$ is not necessary in the output circuit 33' including the improved voltage dividing circuit 52. Thus, the output circuit 33' has an advantage over the output circuit 33 of FIG. 5 in reducing the number of analog switches. It has another advantage of eliminating voltage fluctuation when all the three least significant bits of the digital data are "0". However, the output circuit 33' has a drawback of increasing the number of logic gates in the logic circuit 51 because the logic circuit 51 is slightly more complicated compared with the logic circuit 41 of the output circuit 33. The use of the output circuit 33' in place of the output circuit 33 should therefore be determined in consideration of the above advantages and drawback.

The second point to be considered at the application of the present invention to a practical driver is the magnitude of the current branching to the impedance converter 44 from the connecting points $P_1, P_2, \ldots, P_7$.

In the transient state immediately after one of the analog switches $ASW_{r0}$ to $ASW_{r7}$ is turned on, a current branches, although slightly, from the corresponding one of the connecting points $P_1, P_2, \ldots, P_7$ to the impedance converter 44, so as to charge the input capacitance of the analog switch and the input capacitance of the impedance converter 44.

After a stationary state is established, however, only a leak current generated inside the analog switch and a current based on the input impedance of the impedance converter 44 and the leak current flow. These currents are generally small by some orders of magnitude compared with the current flowing through the resistances r in the voltage dividing circuit 42.

In consideration of the above, the value of the resistances r is preferably determined so that the above branching current becomes substantially negligible. For example, the value of the resistances r satisfying this condition is 1.25 MΩ. However, since the value of the resistances r is not essential to the present invention, it is not limited to 1.25 MΩ. The semiconductor design and fabrication technology is now rapidly progressing. It is therefore meaningless to restrict the value of the resistances r under the premise of the present technology In general, voltage fall (or voltage rise) occurs when a current flows in a circuit having a resistance. When designing a practical driver, therefore, a circuit where a current flows should be distinguished from a circuit where no current flows, and a driver should be designed in consideration of an influence of voltage fall (or voltage rise) as required.

The third point to be considered at the application of the present invention to a practical driver is the ratio of the value of the resistances R in the voltage dividing circuit 10 to the value of the resistances r in the voltage dividing circuit 42 of the output circuit 33.

Figure 9:
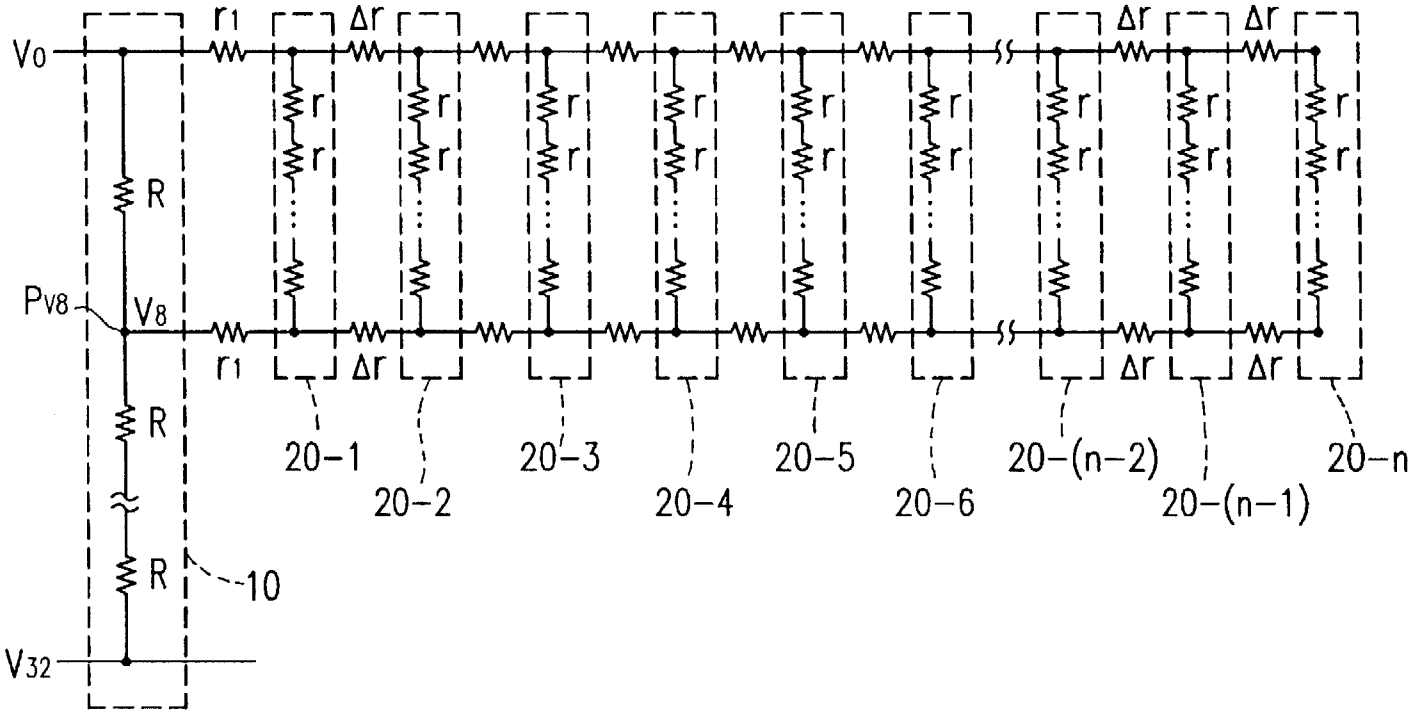
FIG. 9 is an equivalent circuit of the digital driver of FIG. 1.

FIG. 9 is an equivalent circuit of the driver 1 in the case where all the driving circuits 20-1 to 20-n output voltages obtained by further dividing the voltages $V_0$ and $V_8$ output from the voltage dividing circuit 10.

Referring to FIG. 9, each resistance r1 denotes a resistance on a line from the voltage dividing circuit 10 to the voltage dividing circuit 42 of the driving circuit 20-1, and each resistance Δr denotes a resistance on a line between the voltage dividing circuits 42 of any of the adjacent driving circuits 20-1 to 20-n. The values of the resistance r1 and the resistance Δr are far smaller than those of the resistance R in the voltage dividing circuit 10 and the resistance r in the voltage dividing circuit 42. Therefore, when the current branching from a connecting point $P_{V8}$ of the voltage dividing circuit 10 is considered, the values of the resistance r1 and the resistance Δr can be neglected. When the voltage $V_0$ is larger than the voltage $V_8$, a current flows to the connecting point $P_{V8}$. When the voltage $V_0$ is smaller than the voltage $V_8$, a current flows from the connecting point $P_{V8}$.

Figure 10:
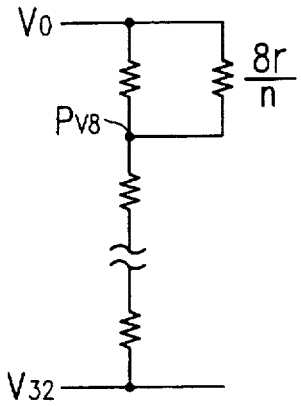
FIG. 10 shows a circuit modified from the equivalent circuit of FIG. 9.

If the values of the resistance r1 and the resistance Δr are neglected, the equivalent circuit of FIG. 9 can be simplified to an equivalent circuit of FIG. 10 where n arrays of resistances are connected in parallel and each of the n arrays of resistances includes eight resistances r.

A plurality of voltage dividing circuits may be provided in the driver 1 to reduce the number of driving circuits for which one voltage dividing circuit is responsible. In this case, the voltages obtained by the voltage dividing circuit 10 are supplied to N driving circuits where $N \leqq n$. In the following description, assume that n=N.

It is observed from FIG. 10 that voltage fluctuation due to a current branching from each connecting point of the voltage dividing circuit 10 can be substantially neglected by determining the values of the resistances r and the resistances R so that R>>8r/n, i.e., nR/8r>>1 (the ratio nR/8r is sufficiently larger than 1). As the ratio nR/8r is closer to 1, the deviation of the voltage obtained by the division by the voltage dividing circuit 10 is larger. It should be noted that the above condition that "all the driving circuits 20-1 to 20-n output voltages obtained by further dividing the voltages $V_0$ and $V_8$ output from the voltage dividing circuit 10" is the condition where the current branching from each connecting point of the voltage dividing circuit 10 is maximum.

Assume that r=1.25 MΩ and n=100. Then, the ratio nR/8r=100 if R=1 KΩ, which satisfies nR/8r>>1. Accordingly, the voltage fluctuation due to a current branching from each connecting point of the voltage dividing circuit 10 can be neglected. Practically, the ratio nR/8r is not required as large as 100 in most cases, but it should preferably be larger than about 10.

The fourth point to be considered at the application of the present invention to a practical driver is the influence of the resistances on the lines from the voltage dividing circuit 10 to the driving circuits 20-1 to 20-n.

Assume that r=1.25 MΩ, $|V_0-V_8|$ is 0.1 V, and n=100. Then, the maximum current flowing in the lines is $0.1/(10M/100)=10^{-6}$ A. If the output deviation due to the resistances of the lines is desired to be within 0.01 V, the resistances of the lines are determined not to exceed $0.01/10^{-6}=10^4\Omega$. The above maximum current actually flows only the line from the voltage dividing circuit 10 to the driving circuit 20-1 (the line having the resistance r1 in FIG. 9), and the current flowing the subsequent lines gradually decreases by each amount of current branching to each driving circuit. In practice, therefore, the condition for the resistances on the lines may be slightly less strict than the above condition. It is nevertheless very effective to calculate the resistances on the lines based on the above-mentioned condition for the estimation thereof.

(EXAMPLE 2)

Figure 11:
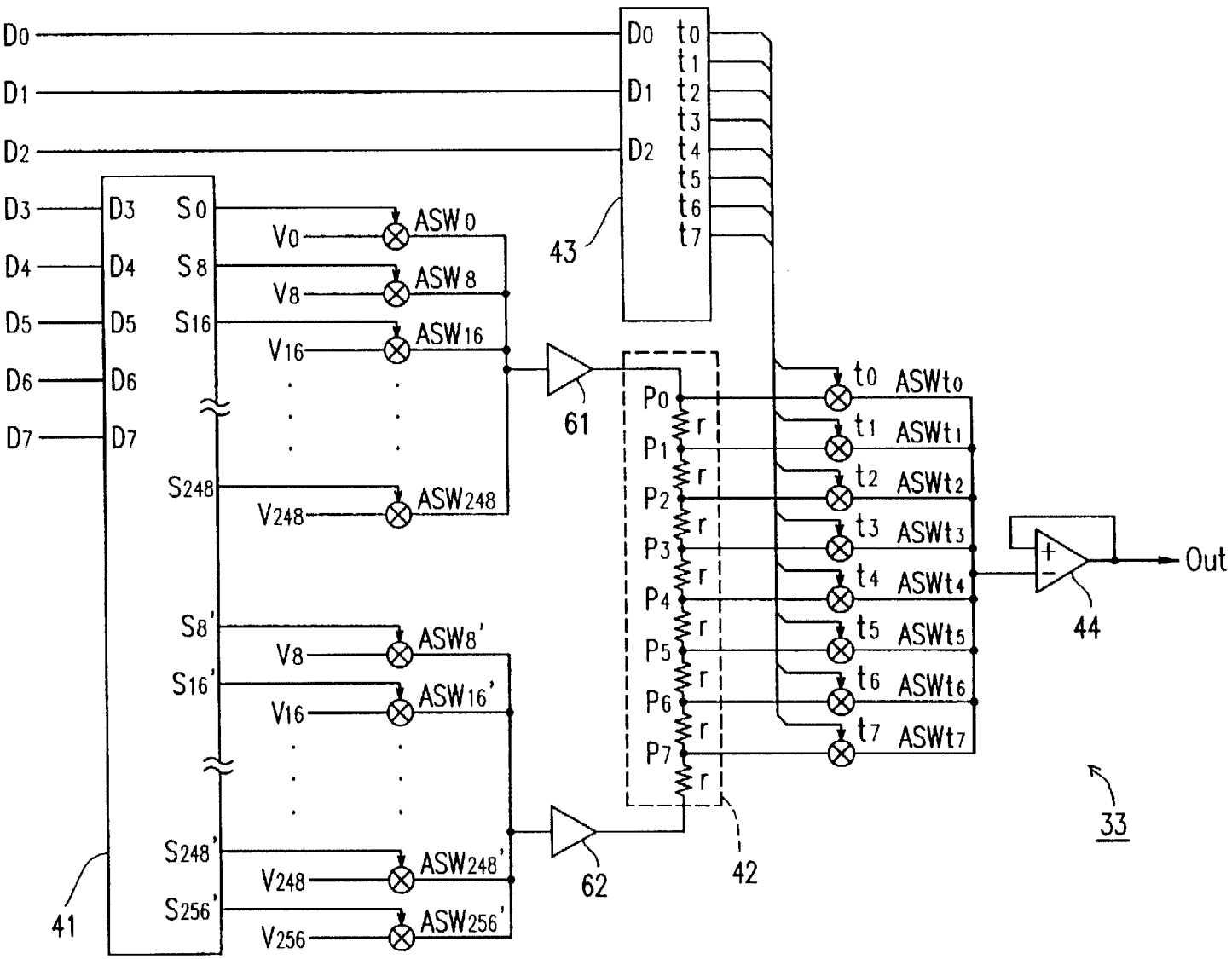
FIG. 11 is a block diagram of another output circuit according to the present invention.

FIG. 11 shows another configuration of the output circuit 33 as Example 2 according to the present invention. In FIG. 11, the same components are denoted by the same reference numerals as those in FIG. 5, and the description thereof is omitted.

In this example, the voltages selected in accordance with the value of the five most significant bits of the digital data are input into the voltage dividing circuit 42 via impedance converters 61 and 62. The input impedances of the impedance converters 61 and 62 are sufficiently large, while the output impedances thereof are sufficiently small to allow a current determined by the potential difference between the selected voltages at an open state and the resistances r in the voltage dividing circuit 42 to flow satisfactorily.

For example, assume that the value of the resistances r is 1.25 KΩ and the potential difference between the selected voltages is 0.1 V. Then, the current flowing the resistances r connected in series in the voltage dividing circuit 42 is 0.1/(1.25×8)=0.01 mA. The output impedances of the impedance converters 61 and 62 are small enough to substantially prevent voltage fluctuation from occurring when a current of 0.01 mA is output. If the output impedances are 100Ω, for example, there occurs a voltage fluctuation of 1 mV or less which is generally small enough to be neglected.

The output impedances of the impedance converters 61 and 62 are defined to cope with both negative and positive currents. More specifically, the output sides of the impedance converters 61 and 62 are configured to allow a current of 0.01 mA, for example, to flow in or out at a voltage fluctuation of 1 mV or less.

The input impedances of the impedance converters 61 and 62 are sufficiently large so that the currents flowing in the impedance converters 61 and 62 are sufficiently small. More specifically, they are sufficiently large so that the total amount of currents flowing in the corresponding impedance converters of all the output circuits of a driver is so small that the influence of voltage fall (or voltage rise) to the lines and the influence of branching currents to the connecting points of the voltage dividing circuit 10 can be neglected. Such an amount can be determined in the substantially the same manner as that described in Example 1, and thus the description thereof is omitted here.

When the voltage at the output terminal of the impedance converter 61 is larger than the voltage at the output terminal of the impedance converter 62, a current of 0.01 mA flows from the impedance converter 61 into the impedance converter 62 via the voltage dividing circuit 42. The potential difference between the impedance converters 61 and 62 is divided by the voltage dividing circuit 42. The voltage selected by the logic circuit 43 among the voltages at the connecting points $P_0$ to $P_7$ in the voltage dividing circuit 42 is output via the impedance converter 44.

The current flows through the voltage dividing circuit 42 from one of the impedance converter 61 and 62 where the voltage is higher to the other thereof where the voltage is lower. Any active devices can be used as the impedance converters 61 and 62 as long as they can realize the same function as that described above. The output circuit in Example 2 is advantageous in that the value of the resistances r in the voltage dividing circuit 42 can be determined comparatively freely.

More specifically, the variation in the values of the resistances r in the voltage dividing circuit 42 causes a deviation in the voltages obtained by the division by the voltage dividing circuit 42. In some facilities for mass production of drivers, the precision of the facilities and the resistance values correlate with each other. If the resistance values are designed unduly large, the variation in the values of the resistances r in the voltage dividing circuit 42 becomes large in some mass production facilities. According to the configuration in Example 2, however, the design of the driver is comparatively free from this restriction.

The configuration having the impedance converters 61 and 62 is not necessarily advantageous over the configuration where the impedance converters 61 and 62 are not provided. The provision of the impedance converters 61 and 62 may impose additional burden on the design or mass production of drivers. Thus, whether or not the impedance converters 61 and 62 should be provided may be determined depending on the conditions such as the specification of the driver, the facility for mass production, and the facility for characteristics measurement.

(EXAMPLE 3)

Figure 12:
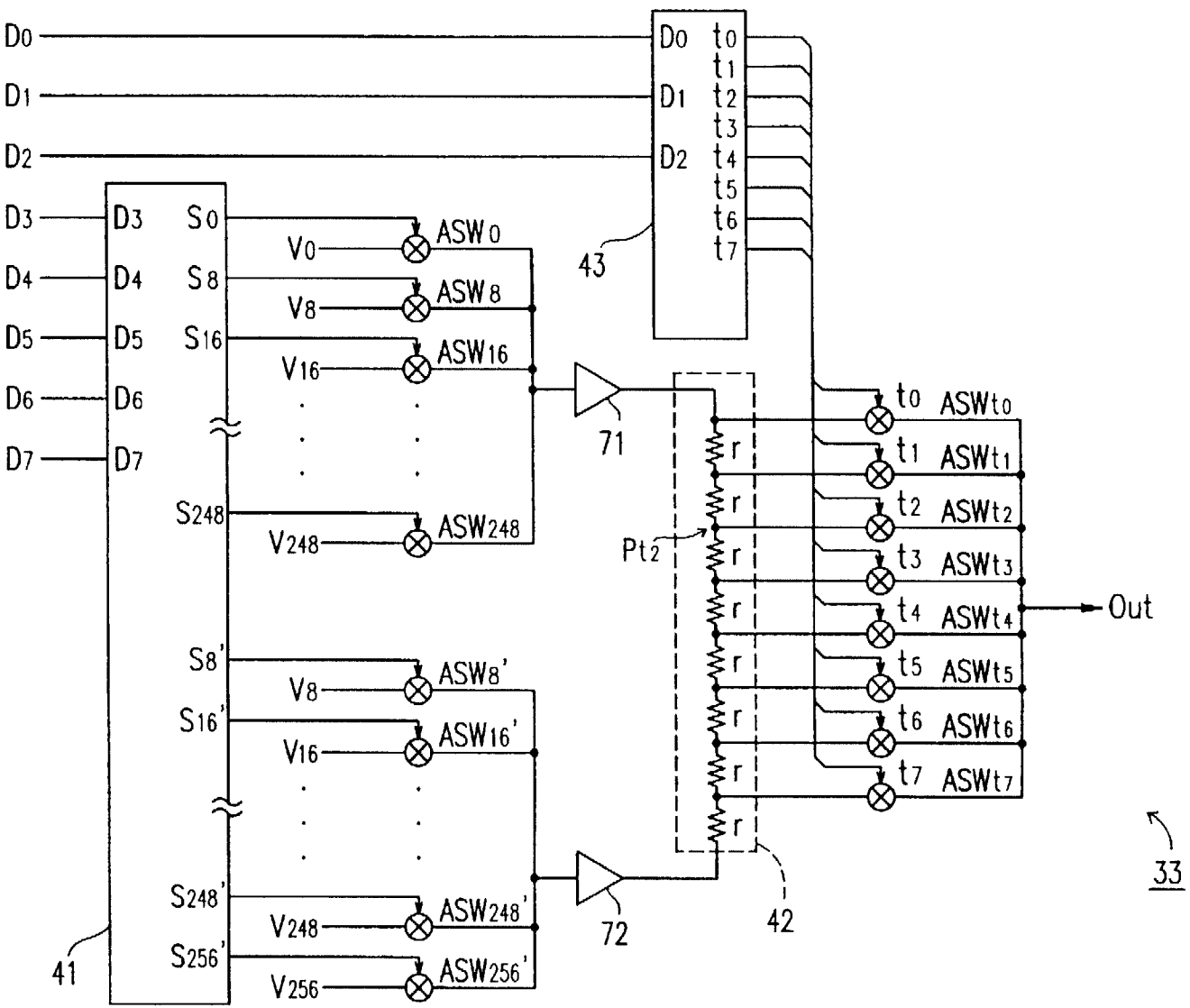
FIG. 12 is a block diagram of still another output circuit according to the present invention.

FIG. 12 shows still another configuration of the output circuit 33 as Example 3 according to the present invention. In FIG. 12, the same components are denoted by the same reference numerals as those in FIG. 11, and the description thereof is omitted.

The output circuit 33 of FIG. 12 is different from the output circuit 33 of FIG. 11 in that the impedance converter 44 is not provided, and that the output current capacitances of impedance converters 71 and 72 are large enough to allow a data line of a display device as a load to be charged (or discharged). The output impedances of the impedance converters 71 and 72 are however designed under the same condition as that described in Example 2. In other words, it is not necessary to make the output impedances unduly small.

Figure 13:
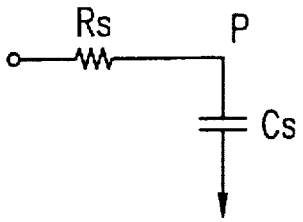
FIG. 13 is an equivalent circuit of a data line as a load.

FIG. 13 is an equivalent circuit of a data line. When a voltage is applied to a load represented by this equivalent circuit, a current no more flows from the driver after a sufficient time has passed. This is because the system is put in a stationary state once the capacitance of the load has been sufficiently charged.

For example, referring to FIG. 12, consider the case where the control signal $t_2$ output from the logic circuit 43 is activated to put on the corresponding analog switch $ASW_{r2}$. The system is put in a stationary state when the voltage at a connecting point $P_{r2}$ in the voltage dividing circuit 42 becomes equal to the voltage at a point P shown in FIG. 13, so that a current branching to the output side from the connecting point $P_{r2}$ in the voltage dividing circuit 42 becomes substantially zero. Thus, the voltage at the connecting point $P_{r2}$ (i.e., the voltage at the load) is a voltage obtained by correct division by the voltage dividing circuit 42.

The impedance converters 71 and 72 are required to be able to charge the load sufficiently within a predetermined period. The predetermined period is, for example, a one-output period (generally, a period when the driver outputs a value corresponding to one unit of data).

The impedance converters 71 and 72 may generate voltage fluctuation in the transient state. The importance is that the impedance converters 71 and 72 can supply (or absorb) a large enough amount of charges to put the system in a stationary state within a predetermined period and that the condition as described in Example 2 is satisfied at the stage when the system has reached the stationary state to minimize the fluctuation of the output voltage.

(EXAMPLE 4)

Figure 14:
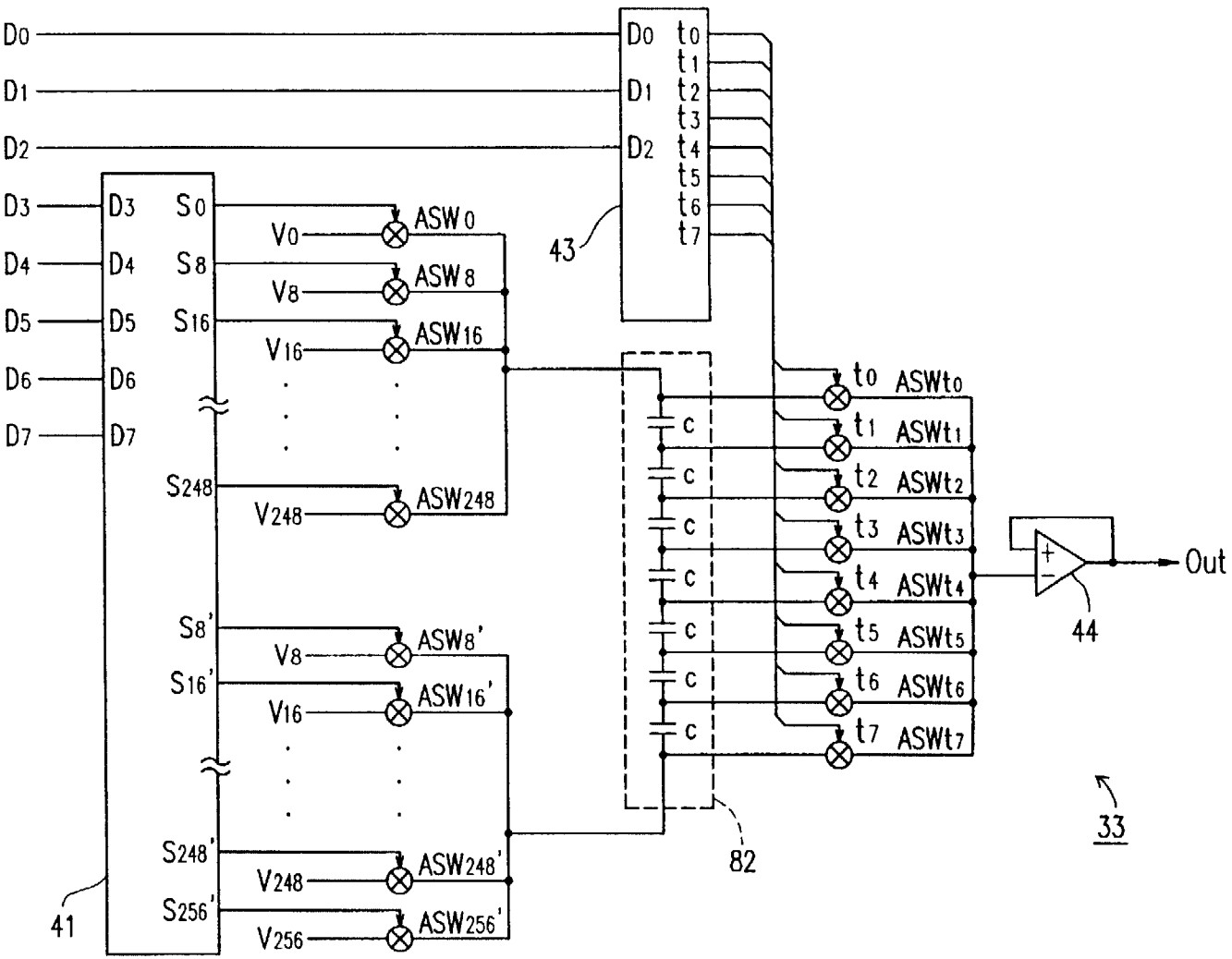
FIG. 14 is a block diagram of still another output circuit according to the present invention.
Figure 15:
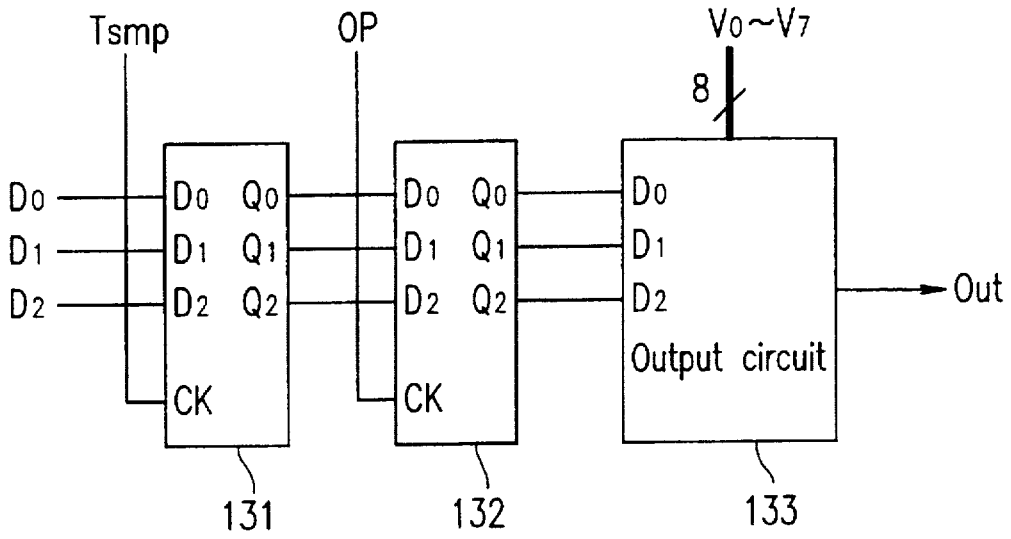
FIG. 15 is a block diagram of a driving circuit of a conventional 3-bit digital driver.
Figure 16:
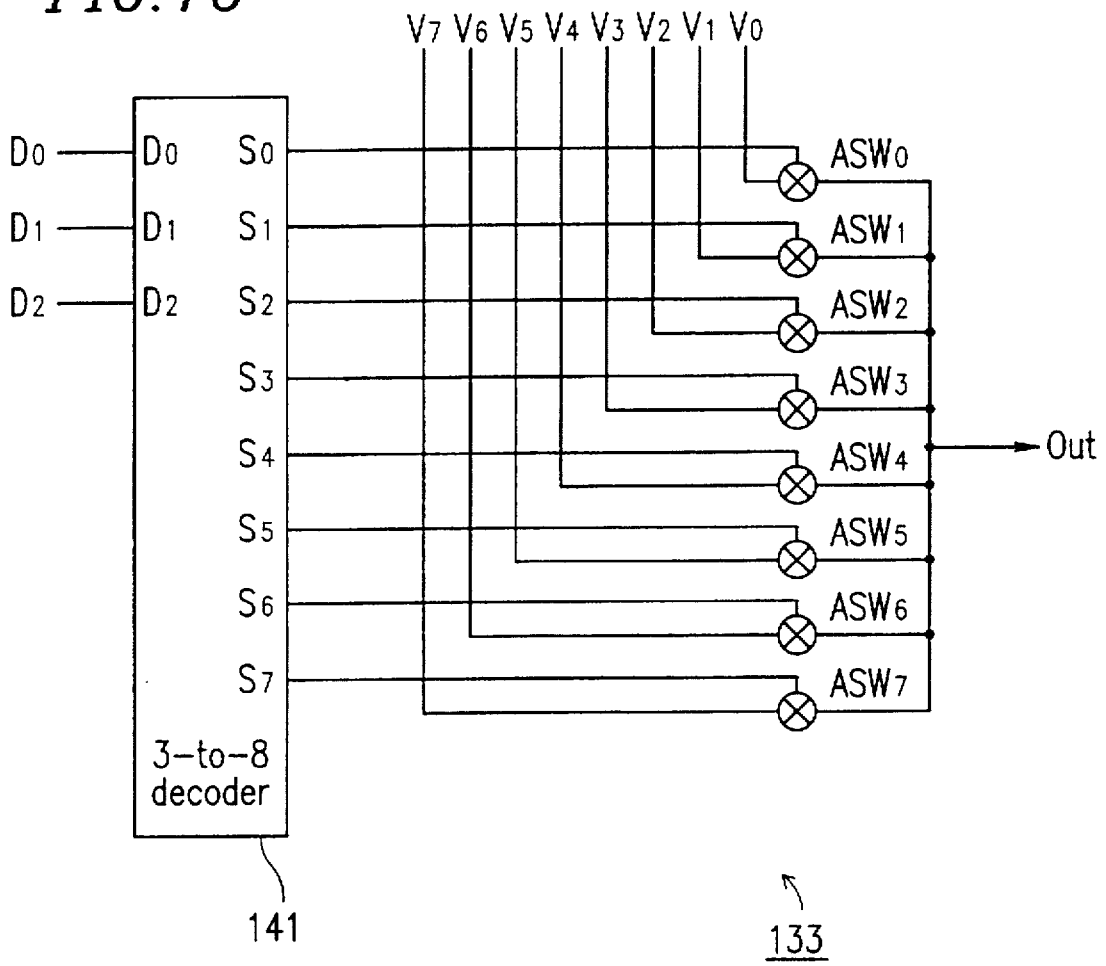
FIG. 16 is a block diagram of an output circuit of the driving circuit of FIG. 15.
Figure 17:
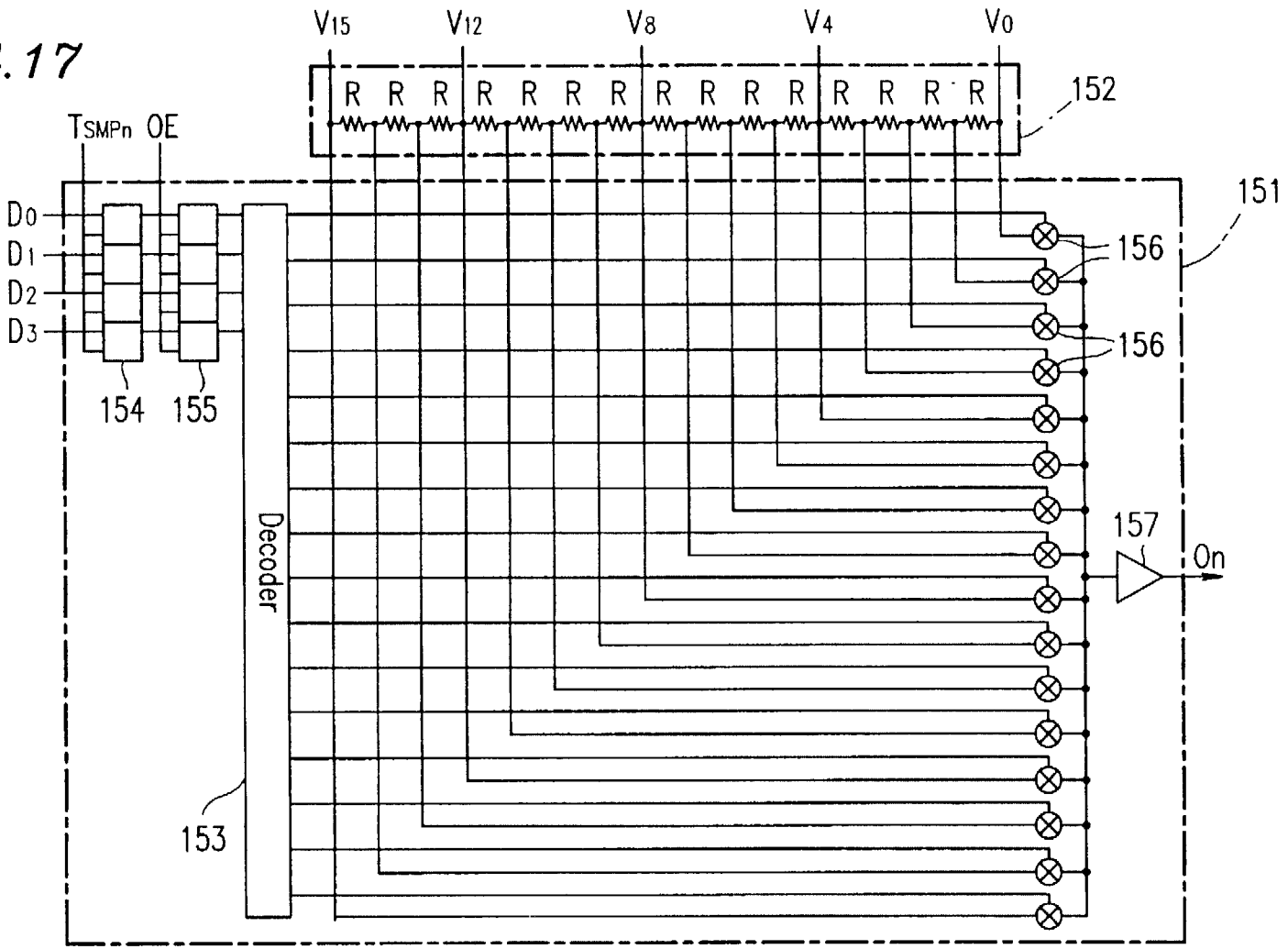
FIG. 17 PRIOR ART
FIG. 17 is a block diagram of a driving circuit and a voltage dividing circuit of a conventional 4-bit digital driver.
Figure 18A:
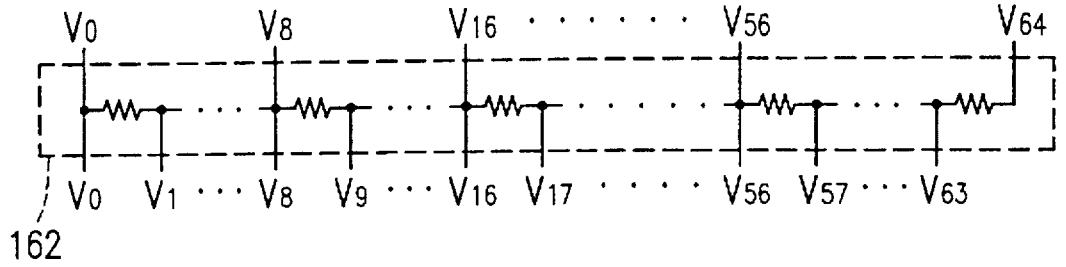
FIG. 18A shows a configuration of a voltage dividing circuit of a conventional 6-bit digital driver.
Figure 18B:
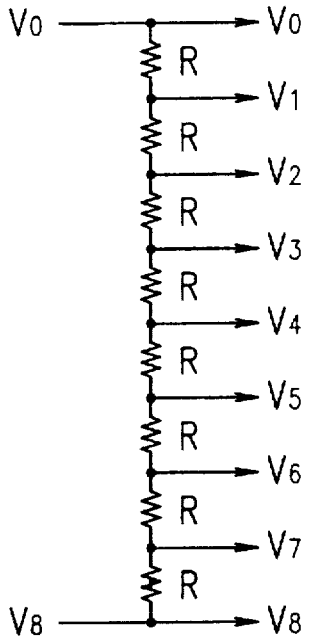
PRIOR ART FIG. 18B
FIG. 18B is a partial view of the voltage dividing circuit of FIG. 18A.
Figure 19:
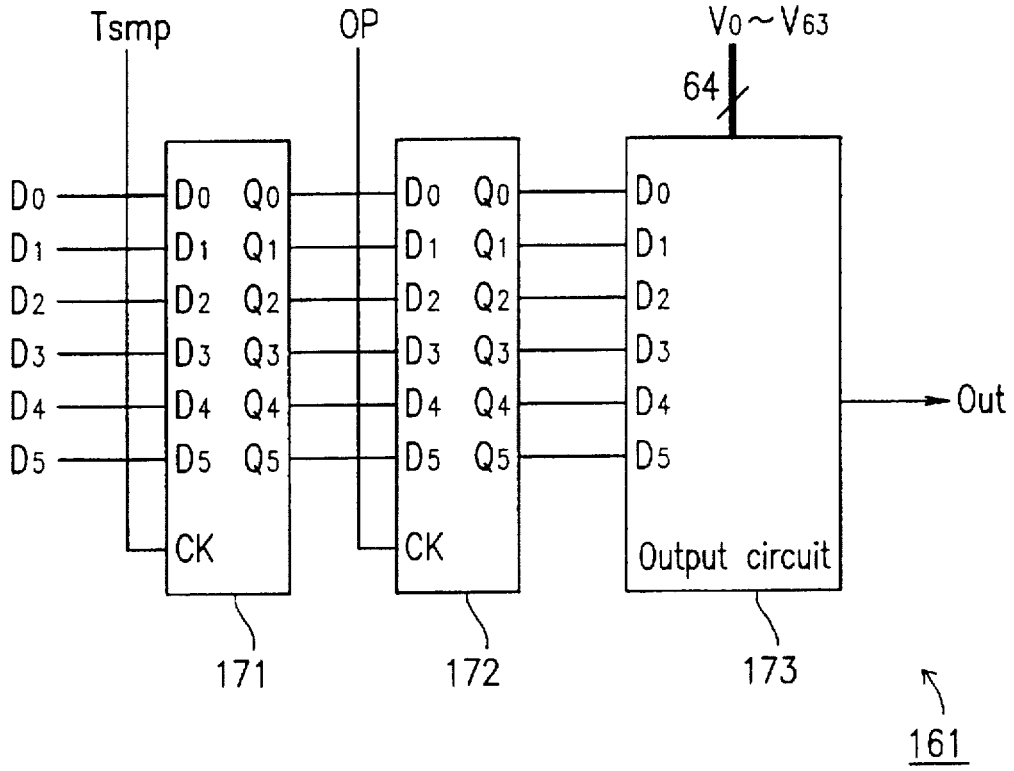
FIG. 19 is a block diagram of a driving circuit of the conventional 6-bit digital driver.
Figure 20:
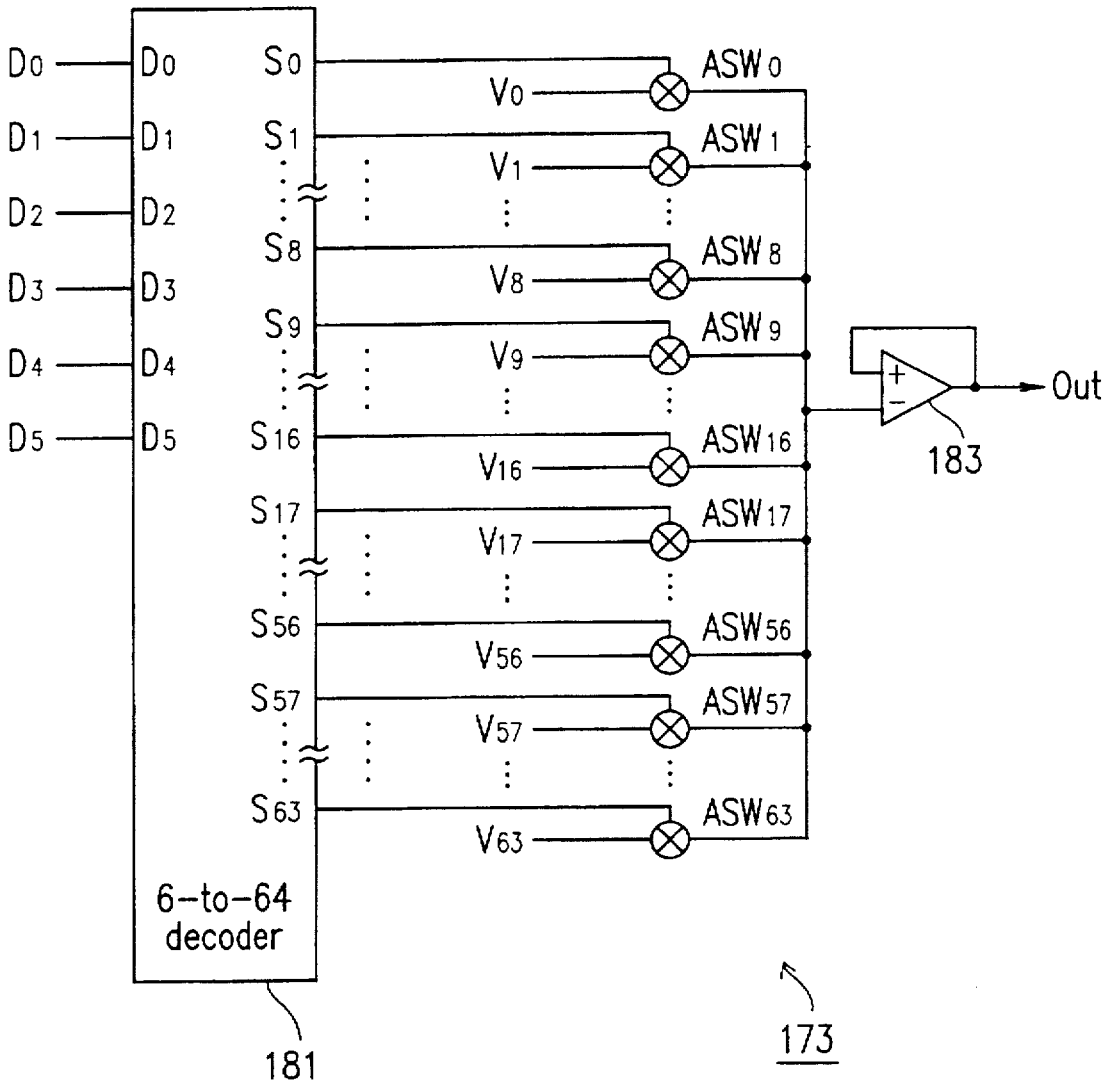
FIG. 20 is a block diagram of an output circuit of the driving circuit of FIG. 19.
Figure 21A:
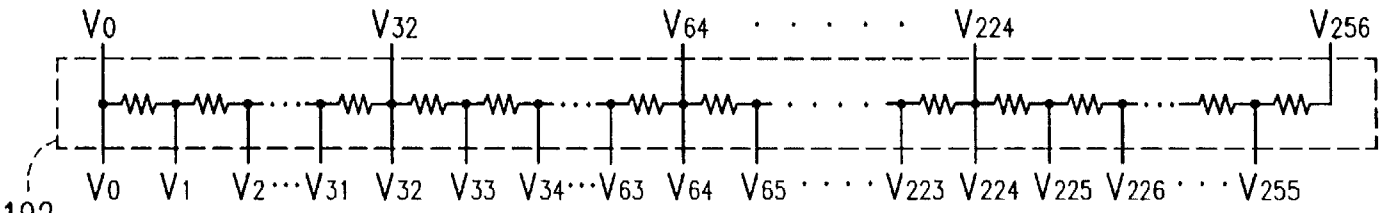
FIG. 21A shows a configuration of a voltage dividing circuit of a conventional 8-bit digital driver.
Figure 21B:
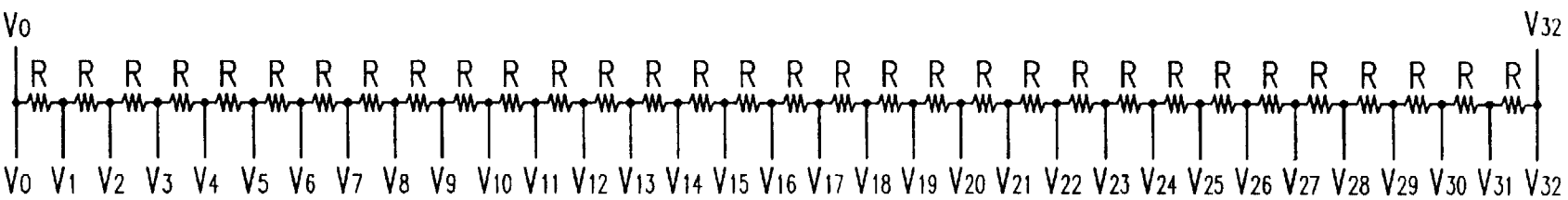
PRIOR ART FIG.21B
FIG. 21B is a partial view of the voltage dividing circuit of FIG. 21A.
Figure 22:
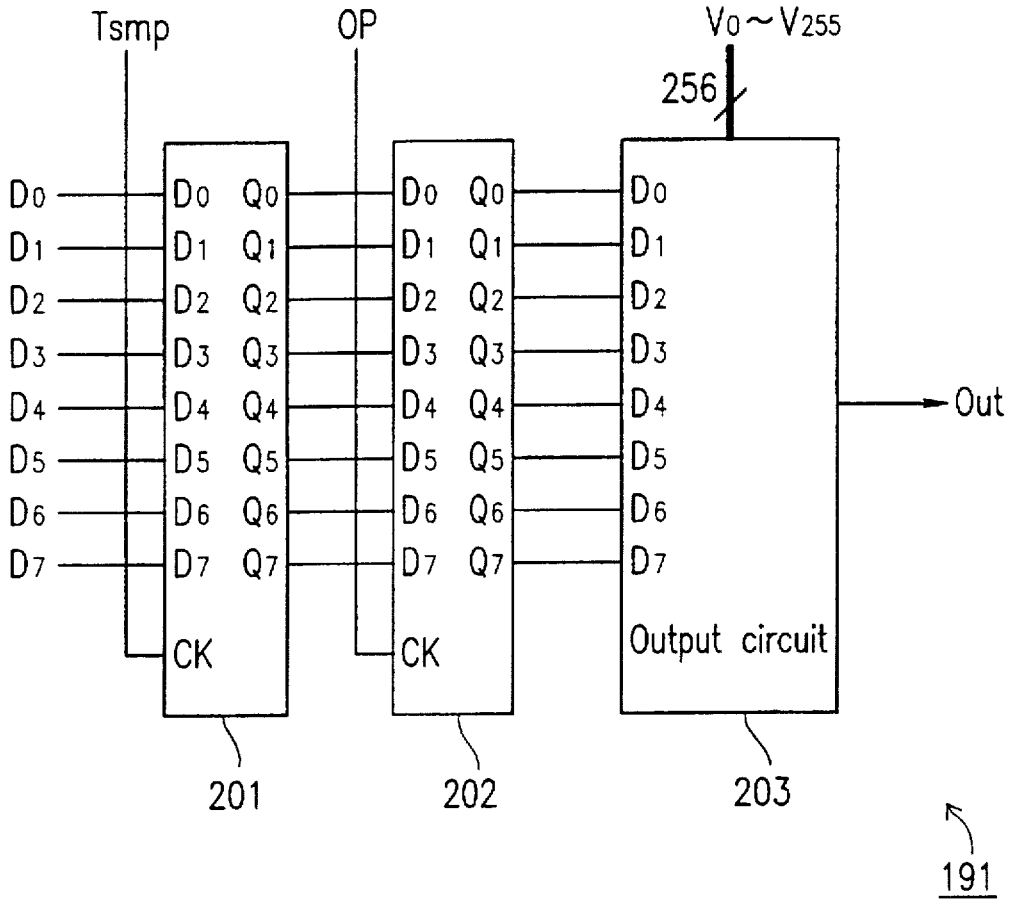
FIG. 22 is a block diagram of a driving circuit of the conventional 8-bit digital driver.
Figure 23:
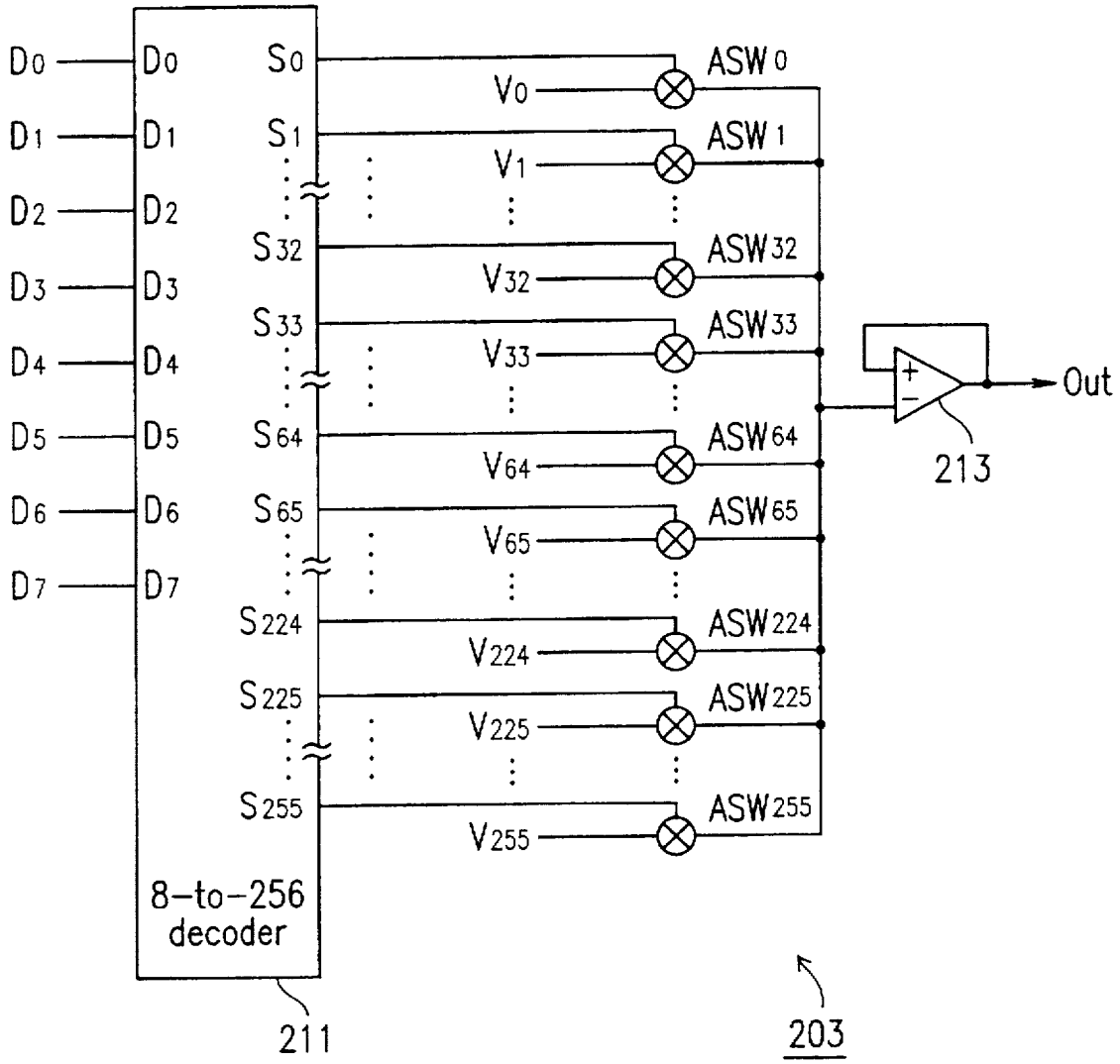
FIG. 23 is a block diagram of an output circuit of the driving circuit of FIG. 22.

FIG. 14 shows still another configuration of the output circuit 33 as Example 4 according to the present invention. In FIG. 14, the same components are denoted by the same reference numerals as those in FIG. 5, and the description thereof is omitted.

In this example, a voltage dividing circuit 82 includes capacitances c connected in series, in place of the resistances r connected in series. Once charges in the capacitances c in the voltage dividing circuit 82 are put in a stable state in accordance with the voltages applied to both ends of the voltage dividing circuit 82, a current no longer flows in the voltage dividing circuit 82. As a result, the voltage dividing circuit 82 is free from voltage fluctuation due to current flow which will arise if it includes the resistances r connected in series. Care should be taken, however, for the designing of this configuration since charges may be dispersed to other capacitances such as input capacitance components in the analog switches, causing voltage fluctuation.

The voltage dividing circuit 10 may also be configured with capacitances C connected in series in place of the resistances R connected in series. In the case of using capacitances for the voltage dividing circuit 10, the relationship between the values of capacitances in the voltage dividing circuit 10 and the voltage dividing circuit 82 can be determined as in the case of using the resistances described above.

Using capacitances for the voltage dividing circuit is advantageous in that no current flows through the voltage dividing circuit unlike the case of using the resistances. However, when the waveform of the gray level voltages is rectangular, the capacitances are charged or discharged.

Accordingly, using capacitances or resistances for the voltage dividing circuit may be determined by the offset between the increase in the power consumption for the charging or discharging and the decrease in the power consumption due to no current flow through the voltage dividing circuit.

The above description was based on the premise of driving an active matrix liquid crystal display device. However, the present invention is not limited to the driving circuit for driving an active matrix liquid crystal display device, but also be applicable to any display devices which perform gray-level display by varying voltages to be applied to pixels depending on input data.

Thus, according to the present invention, a driver for display with a large number of gray levels, such as an 8-bit digital driver, can be realized. The present invention is also applicable to digital drivers other than the 8-bit digital driver, such as a 6-bit digital driver. In such a case, the voltage dividing circuit 10 may be responsible for the three most significant bits of digital data, while the voltage dividing circuit 42 in each output circuit 33 may be responsible for the three least significant bits. It should be understood that other various modifications including those to the 8-bit digital driver can also be considered within the scope of the present invention.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A driving circuit for a display device for displaying a plurality of gray levels in accordance with digital data including a first bit portion and a second bit portion, the driving circuit comprising:

a first voltage dividing circuit for dividing a plurality of gray level voltages so as to generate a plurality of first interpolation voltages between the plurality of gray level voltages;

a first selection circuit for selecting a first voltage and a second voltage different from the first voltage among the plurality of gray level voltages and the plurality of first interpolation voltages in accordance with the first bit portion of the digital data;

a second voltage dividing circuit for dividing the first voltage and the second voltage so as to generate a plurality of second interpolation voltages between the first voltage and the second voltage; and a second selection circuit for selecting one voltage among at least one of the first voltage and the second voltage and the plurality of second interpolation voltages.

2. A driving circuit according to claim 1, further comprising an impedance converter connected to an output of the second selection circuit.

3. A driving circuit according to claim 1, wherein the second voltage dividing circuit includes a plurality of resistances connected in series.

4. A driving circuit according to claim 1, wherein the second voltage dividing circuit includes a plurality of capacitances connected in series.

5. A driving circuit according to claim 1, wherein the first selection circuit determines whether or not a current loop from the first selection circuit through the second voltage dividing circuit back to the first selection circuit is shut off in accordance with the second bit portion of the digital data.

6. A driving circuit according to claim 1, further comprising:

a first impedance converter for receiving the first voltage; and a second impedance converter for receiving the second voltage, wherein the second voltage dividing circuit divides an output of the first impedance converter and an output of the second impedance converter so as to generate the plurality of second interpolation voltages between the output of the first impedance converter and the output of the second impedance converter.

7. A driving circuit according to claim 6, further comprising a third impedance converter connected to the output of the second selection circuit.

* * * * *